US010831127B2

(12) United States Patent
Utsuno et al.

(10) Patent No.: US 10,831,127 B2
(45) Date of Patent: Nov. 10, 2020

(54) DEVELOPING MEMBER, ELECTROPHOTOGRAPHIC PROCESS CARTRIDGE, AND ELECTROPHOTOGRAPHIC IMAGE FORMING APPARATUS

(71) Applicant: CANON KABUSHIKI KAISHA, Tokyo (JP)

(72) Inventors: Fumihiko Utsuno, Moriya (JP); Minoru Nakamura, Mishima (JP); Kazuaki Nagaoka, Susono (JP); Ryo Sugiyama, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/569,768

(22) Filed: Sep. 13, 2019

(65) Prior Publication Data

US 2020/0096898 A1 Mar. 26, 2020

(30) Foreign Application Priority Data

Sep. 21, 2018 (JP) ..... 2018-177854

(51) Int. Cl.
*G03G 15/08* (2006.01)
*G03G 21/18* (2006.01)

(52) U.S. Cl.
CPC ..... *G03G 15/0818* (2013.01); *G03G 15/0808* (2013.01); *G03G 21/1814* (2013.01)

(58) Field of Classification Search
CPC ..... G03G 15/0818; G03G 15/0808; G03G 21/1814
See application file for complete search history.

(56) References Cited

U.S. PATENT DOCUMENTS 7,727,134 B2 6/2010 Nakamura et al.
7,797,833 B2 9/2010 Nakamura et al.
7,798,948 B2 9/2010 Kawamura et al.
(Continued)

FOREIGN PATENT DOCUMENTS

EP 1 693 715 8/2006
JP H04-88381 A 3/1992
(Continued)

OTHER PUBLICATIONS

U.S. Appl. No. 16/516,790, Kazutoshi Ishida, filed Jul. 19, 2019.
(Continued)

*Primary Examiner* — Sandra Brase
(74) *Attorney, Agent, or Firm* — Venable LLP

(57) ABSTRACT

Provided is an electrophotographic developing member capable of sufficiently increasing a density of an image initially output from a standby state. The developing member includes: a substrate; a porous electroconductive elastic layer on the substrate; and an electroconductive solid layer on the electroconductive elastic layer, in which an outer surface of the developing member includes a first region having an electrical insulating surface and a second region having an electroconductive surface, the first region and the second region are arranged to be adjacent to each other, and the first region is constituted by an electrical insulating portion disposed on an outer surface of the electroconductive solid layer.

10 Claims, 3 Drawing Sheets

(56) References Cited

U.S. PATENT DOCUMENTS

| | | | | |
|---|---|---|---|---|
| 7,799,398 | B2 | 9/2010 | Nakamura et al. | |
| 8,655,222 | B2 | 2/2014 | Nakamura et al. | |
| 8,655,238 | B2 | 2/2014 | Uno et al. | |
| 8,745,870 | B2 | 6/2014 | Kawamura et al. | |
| 8,768,227 | B2 | 7/2014 | Urushihara et al. | |
| 8,798,508 | B2 | 8/2014 | Yamada et al. | |
| 8,874,007 | B2 | 10/2014 | Kawamura et al. | |
| 9,625,854 | B2 | 4/2017 | Koyanagi et al. | |
| 9,846,407 | B2 | 12/2017 | Nakamura et al. | |
| 9,921,518 | B2 | 3/2018 | Sakurai et al. | |
| 9,952,531 | B2 | 4/2018 | Ishii et al. | |
| 9,952,532 | B2 | 4/2018 | Sugiyama et al. | |
| 10,303,079 | B2 | 5/2019 | Utsuno et al. | |
| 10,310,447 | B2 | 6/2019 | Morishita et al. | |
| 2013/0164038 | A1 | 6/2013 | Kusaba et al. | |
| 2013/0196836 | A1* | 8/2013 | Ichizawa ..... | G03G 15/0233 492/18 |
| 2013/0243499 | A1* | 9/2013 | Ishikura ..... | G03G 15/0812 399/284 |
| 2013/0266339 | A1 | 10/2013 | Sugiyama et al. | |
| 2015/0055989 | A1 | 2/2015 | Goto et al. | |
| 2017/0097580 | A1 | 4/2017 | Ishida et al. | |
| 2017/0139336 | A1 | 5/2017 | Nagaoka et al. | |
| 2017/0248867 | A1* | 8/2017 | Sakurai ..... | G03G 15/0808 |
| 2019/0094741 | A1 | 3/2019 | Uno et al. | |
| 2019/0265609 | A1 | 8/2019 | Sakurai et al. | |
| 2019/0324382 | A1 | 10/2019 | Sugiyama et al. | |

FOREIGN PATENT DOCUMENTS

| | | | |
|---|---|---|---|
| JP | H10-91000 | A | 4/1998 |
| JP | 3007671 | B2 | 2/2000 |
| JP | 3035628 | B2 | 4/2000 |
| JP | 2004-279578 | A | 10/2004 |
| JP | 2011-164399 | A | 8/2011 |

OTHER PUBLICATIONS

U.S. Appl. No. 16/524,794, Shohei Urushihara, filed Jul. 29, 2019.
U.S. Appl. No. 16/525,693, Seiji Tsuru, filed Jul. 30, 2019.
U.S. Appl. No. 16/526,125, Sosuke Yamaguchi, filed Jul. 30, 2019.
U.S. Appl. No. 16/540,463, Noriyuki Doi, filed Aug. 14, 2019.
U.S. Appl. No. 16/541,732, Kazuhito Wakabayashi, filed Aug. 15, 2019.
U.S. Appl. No. 16/545,434, Kenta Matsunaga, filed Aug. 20, 2019.
U.S. Appl. No. 16/672,770, Wataru Moriai, filed Nov. 4, 2019.
U.S. Appl. No. 16/695,754, Kazutoshi Ishida, filed Nov. 26, 2019.

* cited by examiner

DEVELOPING MEMBER, ELECTROPHOTOGRAPHIC PROCESS CARTRIDGE, AND ELECTROPHOTOGRAPHIC IMAGE FORMING APPARATUS

BACKGROUND

The present disclosure relates to an electrophotographic developing member for electrophotography, an electrophotographic process cartridge, and an electrophotographic image forming apparatus.

DESCRIPTION OF THE RELATED ART

Japanese Patent Application Laid-Open No. H04-88381 discloses a developing member capable of conveying a large amount of toner by at least partially exposing insulating particles on a surface to generate a large number of micro closed electric fields in the vicinity of the surface and sucking a charged toner using the closed electric fields.

Recently, from the viewpoint of usability, an image forming apparatus is required to shorten a first print out time (hereinafter, referred to as "FPOT"), which is a time required to print a first sheet from a standby state, more than ever. According to our study, in the case in which a developing member according to Japanese Patent Application Laid-Open No. H04-88381 was used for forming an electrophotographic image, when a solid black (100% density) image was output from a standby state, in some cases, an image of which a density was not enough was output. Further, in some cases, a density of a halftone (half tone density) image initially output from the standby state was low and different from that of a halftone image output later.

SUMMARY

An aspect of the present disclosure is directed to providing an electrophotographic developing member capable of sufficiently increasing a density of an image initially output from a standby state. Another aspect of the present disclosure is directed to providing an electrophotographic process cartridge contributing to stably forming a high-quality electrophotographic image. Still another aspect of the present disclosure is directed to providing an electrophotographic image forming apparatus capable of stably forming a high-quality electrophotographic image.

According to an aspect of the present disclosure, there is provided an electrophotographic developing member including: a substrate; a porous electroconductive elastic layer on the substrate; and an electroconductive solid layer on the elastic layer, in which an outer surface of the developing member includes a first region having an electrical insulating surface and a second region having an electroconductive surface, the first region and the second region are arranged to be adjacent to each other, and the first region is constituted by an electrical insulating portion disposed on an outer surface of the solid layer.

According to another aspect of the present disclosure, there is provided an electrophotographic process cartridge detachably attachable to a main body of an electrophotographic image forming apparatus, the electrophotographic process cartridge at least including: a toner container including a toner; and a developing unit that conveys the toner, in which the developing unit includes the electrophotographic developing member described above.

According to still another aspect of the present disclosure, there is provided an electrophotographic image forming apparatus at least including: an electrophotographic photosensitive member; a charging unit disposed to be able to charge the electrophotographic photosensitive member; and a developing unit that supplies a toner to the electrophotographic photosensitive member, in which the developing unit includes the electrophotographic developing member described above.

Further features of the present invention will become apparent from the following description of exemplary embodiments with reference to the attached drawings.

DESCRIPTION OF THE EMBODIMENTS

Figure 1A:
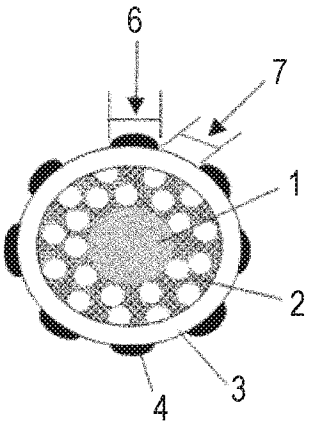
FIGS. 1A, 1B, 1C and 1D are schematic partial views illustrating an example of a cross section of a developing member according to the present disclosure.

As a result of studies, the present inventors found that an electrophotographic developing member having the following configuration can sufficiently increase a density of an image initially output from a standby state. That is, an electrophotographic developing member according to one aspect of the present disclosure includes: a substrate; a porous electroconductive elastic layer on the substrate; and an electroconductive solid layer on the electroconductive elastic layer. An outer surface of the developing member includes a first region having an electrical insulating surface and a second region having an electroconductive surface, in which the first region and the second region are arranged to be adjacent to each other, and the first region is constituted by an electrical insulating portion disposed on an outer surface of the solid layer.

The charging of the electrical insulating portion is performed mainly at a contact portion between the developing member and a toner regulating member, by the friction between the toner conveyed through the contact portion and the electrical insulating portion.

It is thought that the reason why a density of an electrophotographic image output first from the standby state is insufficient is that charges are not sufficiently accumulated in the electrical insulating portion at the time of initially outputting the image at the first sheet output from the standby state and thus a sufficient amount of a developer is not adsorbed in the electrical insulating portion.

That is, when an electrophotographic image forming apparatus is in the standby state, the electrical insulating portion of the developing member is in an uncharged state. At the time of initially outputting the image at the first sheet output from this state, since the number of times that the electrical insulating portion is rubbed with the toner is small, sufficient charges are not accumulated in the electrical insulating portion. As a result, it is thought that a gradient force enough to attract a sufficient amount of toner to the electrical insulating portion to form a black solid image does not occur, and thus a black solid image having an insufficient density or a halftone image is formed.

Meanwhile, the developing member can rapidly charge the electrical insulating portion even at a process of initially forming an image at the first sheet output from the standby state, such that a density of the image initially output from the standby state can be sufficiently increased.

The reason is thought that in the developing member, a flow of the toner in the contact portion with the toner regulating member is promoted, and thus, the charging of the electrical insulating portion by the friction between the electrical insulating portion and the toner is promoted. That is, it is thought that in the contact portion between the developing member and the toner regulating member, a pressure applied to the toner passing through the contact portion becomes uniform by two phenomena described in the following i) and ii) to increase flowability of the toner.

i) It is thought that in the contact portion (nip) between the developing member and the toner regulating member, the pressure applied to the toner in a moving direction of the surface of the developing member, that is, a toner conveyance direction can be made uniform, and thus retention of the toner is suppressed. That is, the surface of the developing member is deformed by contact with the toner regulating member, and for example, in the case in which a cylindrical developing roller rotating based on an axis of a cylinder and a flat plate-shaped toner regulating member come in contact with each other, a deformation amount thereof is continuously changed from an upstream to a downstream of the moving direction of the surface of the developing member.

As in the developing member, a porous electroconductive elastic layer, hereinafter, also referred to as an "electroconductive layer", is compressed to thereby be deformed by contact with a toner regulating member. In this case, pores, such as air bubbles or the like, in the porous layer are preferentially collapsed. Therefore, since a deformation amount of other portions except for the pores of the porous layer, that is, an elastic body itself that constitutes a skeleton portion, is small, distortion generated in the porous layer is also reduced. As a result, even when the deformation amount of the surface of the developing member in the nip is changed in the moving direction, fluctuation of a reaction force of the distortion is decreased, and the pressure in the moving direction of the surface of the developing member in the nip becomes uniform.

ii) As described in i), pressure distribution on the toner in the nip in the moving direction of the developing member can become uniform by an action of the porous layer. However, even by directly providing the electrical insulating portion directly on the porous layer, fine pressure fluctuation occurs in the nip, and it is difficult to stably charge the electrical insulating portion early. That is, when the porous layer receives a pressing force from the toner regulating member at the contact portion, the reaction force is decreased at the portion where the pores exist in the surface, and the reaction force is increased at the portion where the pores do not exist. For this reason, it is thought that fine pressure fluctuation originating in the pores is caused to the pressure which the toner receives in the nip only by simply using the porous layer. Therefore, in the case in which the electrical insulating portion is directly provided on the surface of the porous layer, the charging of the electrical insulating portion is not sufficiently promoted.

Meanwhile, the developing member has the electroconductive solid layer (hereinafter, also referred to as a "solid layer") on the porous layer. Fine pressure fluctuation derived from the pores can be suppressed by interposing the solid layer between the outer surface of the porous layer and the electrical insulating portion, such that the pressure applied to the toner becomes uniform.

Hereinafter, the developing member according to the present aspect will be described in detail.

[Developing Member]

The developing member includes a substrate 1, a porous electroconductive elastic layer 2 on the substrate 1, and an electroconductive solid layer 3 on the elastic layer 2 as illustrated in FIGS. 1A to 1D. Further, the outer surface of the developing member includes a first region 6 having an electrical insulating surface and a second region 7 having an electroconductive surface. The first region 6 and the second region 7 are arranged to be adjacent to each other, and the first region 6 is constituted by an electrical insulating portion 4 on an outer surface of the solid layer.

Figure 1B:
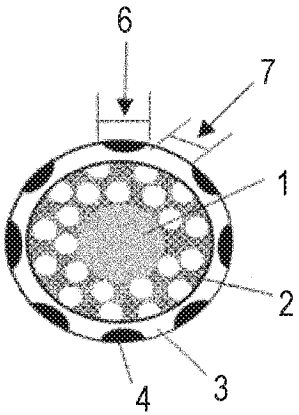
Figure 1C:
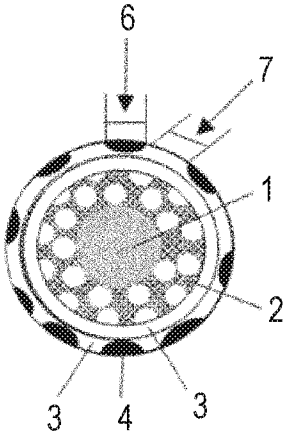
Figure 1D:
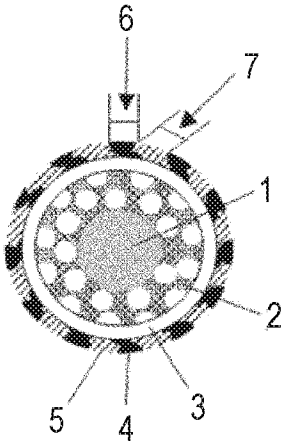

Further, the second region 7 having the electroconductive surface may be constituted by the outer surface of the solid layer 3 as illustrated in FIG. 1A, 1B, or 1C or may be constituted by an outer surface of an electroconductive portion 5 on the solid layer 3 as illustrated in FIG. 1D.

Further, the first region and the second region may be continuously present or scattered, respectively. Among them, the first regions are scattered in a continuous second region, which is preferable in that it is easy to stably form first regions in which a convex portion to be described below is formed.

An example of a shape of the developing member according to the present disclosure can include a sleeve, a belt, and the like in addition to a roller as illustrated in FIGS. 1A to 1D.

<Substrate>

The substrate can have electroconductivity and have a function of supporting a covered layer or an electroconductive elastic layer provided thereon. An example of a material of the substrate can include metals such as iron, copper, aluminum, nickel, and the like; and alloys containing these metals such as stainless steel, duralumin, brass, bronze, and the like. One of these materials may be used alone, or two or more of them may also be used in combination. A surface of the substrate may be plated for the purpose of imparting scratch resistance as long as the electroconductivity is not impaired. Further, a substrate of which a surface is made electroconductive by coating a metal on a surface of a substrate made of a resin material or a substrate made of an electroconductive resin composition may be used.

<Porous Electroconductive Elastic Layer>

The porous electroconductive elastic layer (porous layer) is provided on the substrate and is a layer in which pores are formed in an elastic material such as a resin or rubber having electroconductivity. By forming pores in the elastic material such as the resin or rubber having electroconductivity, it is possible to suppress pressure fluctuation accompanying distortion of the elastic layer.

Specific examples of the resin used in the porous layer are as follows:

polyurethane resins, polyamide resins, melamine resins, fluoride resins, phenol resins, alkyd resins, silicone resins, and polyester resins. One of these resins may be used alone or two or more thereof may also be used in combination. Among them, the polyurethane resin is preferable in that the polyurethane resin easily contains pores and is excellent in permanent deformation and flexibility, and it is easy to design mechanical properties.

As the polyurethane resin, ether based polyurethane resins, ester based polyurethane resins, acrylic polyurethane resins, carbonate based polyurethane resins can be mentioned. Among them, the polyether based polyurethane resin is particularly preferable in that it is easy to achieve flexibility.

The polyether based polyurethane resin can be obtained by a reaction between polyether polyol and an isocyanate compound known in the art. Examples of the polyether polyol can include polyethylene glycol, polypropylene glycol, and polytetramethylene glycol. In addition, if necessary, as these polyol components, prepolymers formed by chain extension with an isocyanate such as 2,4-tolylene diisocyanate, 2,6-tolylene diisocyanate (TDI), diphenylmethane diisocyanate (MDI), isophorone diisocyanate (IPDI) may be used.

The isocyanate compound reacted with these polyol components is not particularly limited, but examples thereof are as follows:

aliphatic polyisocyanates such as ethylene diisocyanate and 1,6-hexamethylene diisocyanate (HDI); cycloaliphatic polyisocyanates such as isophorone diisocyanate (IPDI), cyclohexane 1,3-diisocyanate, and cyclohexane 1,4-diisocyanate; aromatic polyisocyanates such as 2,4-tolylene diisocyanate, 2,6-tolylene diisocyanate (TDI), and diphenylmethane diisocyanate (MDI); and their modified products, copolymers, and blocks thereof.

Examples of the rubber used in the porous layer are as follows:

rubbers such as ethylene-propylene-diene copolymer rubber (EPDM), acrylonitrile-butadiene rubber (NBR), chloroprene rubber (CR), natural rubber (NR), isoprene rubber (IR), styrene-butadiene rubber (SBR), fluororubber, silicone rubber, epichlorohydrin rubber, hydrides of NBR, urethane rubber, and the like. If necessary, one of these rubbers may be used alone or two or more thereof may also be used in combination. Among them, the silicone rubber can be preferably used.

Examples of the silicone rubber can include polydimethylsiloxane, polymethyltrifluoropropylsiloxane, polymethylvinylsiloxane, polyphenylvinylsiloxane, and copolymers of these siloxanes.

The porous layer can have electroconductivity by blending an electroconductivity imparting agent such as an electron conductive material or ion conductive material with the elastic material. Examples of the electron conductive material can include the following materials:

electroconductive carbon, for example, carbon black such as ketjen black EC and acetylene black;

carbon black for rubber such as super abrasion furnace (SAF), intermediate SAF (ISAF), high abrasion furnace (HAF), fast extruding furnace (FEF), general purpose furnace (GPF), semi-reinforcing furnace (SRF), fine thermal (FT), and medium thermal (MT);

oxidized carbon for color (ink); and metals such as copper, silver, germanium, and metal oxides thereof.

Among them, the electroconductive carbon is preferable since it is easy to control electroconductivity with a small amount.

Examples of the ion conductive material can include the following materials:

inorganic ion conductive materials such as sodium perchlorate, lithium perchlorate, calcium perchlorate and lithium chloride; and organic ion conductive materials such as modified aliphatic dimethyl ammonium ethosulfate and stearyl ammonium acetate.

Further, if necessary, various additives such as a catalyst, a foam stabilizer, a surfactant, a foaming agent, particles, a plasticizer, a filler, a bulking agent, a vulcanizing agent, a vulcanizing aid, a crosslinking aid, a curing inhibitor, an antioxidant, an antiaging agent, a processing aid, and a surface modifier can be contained in the porous layer. These optional components can be blended in amounts in which a function of the porous layer is not inhibited.

Examples of the catalyst used as needed can include the following materials:

amine based catalysts such as 1,2-dimethyl imidazole, triethylamine, tripropylamine, tributylamine, hexadecyl dimethylamine, N-methyl morpholine, N-ethyl morpholine, N-octadecyl morpholine, diethylenetriamine, N,N,N',N'-tetramethylethylenediamine, N,N,N',N'-tetramethylpropylenediamine, N,N,N',N'-tetramethylbutanediamine, N,N,N',N'-tetramethyl-1,3-butaneamine, N,N,N',N'-tetramethylhexamethylenediamine, bis[2-(N,N-dimethylamino)ethyl] ether, N,N-dimethylbenzylamine, N,N-dimethylcyclohexylamine, N,N,N',N',N'',N''-pentamethyldiethylenetriamine, triethylenediamine, salts of triethylenediamine, oxyalkylene adducts of amino groups of primary and secondary amines, azacyclo compounds such as 1,8-diazabicyclo(5,4,0)undecen-7,1,5-diazabicyclo(4,3,0)nonene-5,N,N-dialkylpiperazines, various N,N',N''-trialkylaminoalkylhexahydrotriamines, and the like;

organic metal based urethanization catalyst such as tin acetate, tin octylate, tin octoate, tin oleate, tin laurate, dibutyltin dichloride, dibutyltin dilaurate, dibutyltin diacetate, tetra-i-propoxy titanium, tetra-n-butoxy titanium, tetrakis(2-ethylhexyloxy)titanium, lead naphthenate, nickel naphthenate, and cobalt naphthenate; and organic acid salt catalysts (carboxylates, borates, etc.) in which an initial activity of the amine based catalyst or the organic metal based urethanization catalyst is reduced.

The pores of the porous layer may be independent of one another or may be in communication with one another. Particularly, independent pores are preferable because they are less likely to cause pressure fluctuations accompanying distortion of the porous layer and fine pressure fluctuations originating from the pores in the vicinity of the surface of the porous layer.

Moreover, although unevenness caused by the pores that is not accompanied with a thin film of a resin may be exposed or may not be exposed to surface of the porous layer, the unevenness is not exposed to the surface, which is preferable in that the pressure fluctuation accompanying distortion of the porous layer or fine pressure fluctuation derived from the pores in the vicinity of the surface of the porous layer is less likely to occur.

Further, it is preferable that a volume ratio (that is, porosity) of the pores occupying a total volume of the porous layer be preferably 15% or more and 80% or less. When the porosity is 15% or more, it is easy to decrease pressure fluctuation accompanying distortion of the porous layer, and when the porosity is 80% or less, it is easy to suppress fine pressure fluctuation derived from the pores in the vicinity of the surface of the porous layer. The porosity in the present disclosure can be measured by a method described in Examples.

In addition, it is preferable that a diameter of the pore be 10 μm or more and 300 μm or less. When the diameter of the pore is 10 μm or more, it is easier to decrease pressure fluctuation accompanying distortion of the porous layer, and when the porosity is 300 μm or less, it is easier to suppress fine pressure fluctuation derived from the pores in the vicinity of the surface of the porous layer. The diameter of the pore in the present disclosure can be measured by a method described in Examples.

The pore of the porous layer can be formed by a method of allowing a microballoon to be contained in the electroconductive elastic layer, in addition to a mechanical froth method and a chemical foaming method. Among them, the mechanical froth method is preferable in that this method can make it easy to form independent pores (independent air bubbles) and make it difficult to expose the pores to the surface, and thus, pressure fluctuation accompanying distortion of the porous layer or fine pressure fluctuation derived from the pores in the vicinity of the surface of the porous layer is less likely to occur.

The mechanical froth method is a method of foaming while mixing an inert gas with a raw material of the porous layer and mechanically stirring. In the mechanical froth method, the porosity can be adjusted by an amount of the inert gas to be mixed. Further, the diameter of the pore can be adjusted by the kind or a mixed amount of foam stabilizer or surfactant, mechanical stirring condition, and the like. As the inert gas, nitrogen, dried air, carbon dioxide, argon, helium, and the like can be used. In addition, as the foam stabilizer, water-soluble polyether siloxane from polydimethylsiloxane and an EO/PO copolymer, a sodium salt of sulfonated ricinoleic acid, a mixture of these materials and a polysiloxan/polyoxyalkylene copolymer, and the like can be used.

<Electroconductive Solid Layer>

The electroconductive solid layer is an electroconductive elastic layer that does not substantially contain pores in the layer. One or more electroconductive solid layers are formed on the porous layer.

It is possible to suppress fine pressure fluctuation derived from the pores in the vicinity of the surface of the porous layer by forming the electroconductive solid layer on the porous layer. In addition, the phrase "does not substantially contain pores" means that the pores are not intentionally provided, but the presence of the pores inevitably formed such as a scratch, crack, fragment, or the like, of a material are acceptable.

Further, the electroconductive solid layer has an electrical insulating portion to be described below which constitutes the first region on the outer surface thereof. That is, the electroconductive solid layer is interposed between the porous layer and the electrical insulating portion. Therefore, image defects such as black spots, or the like, at the time of outputting an image can be suppressed. When the electrical insulating portion is formed on the surface of the porous layer, the pores exposed to the surface of the porous layer and the electrical insulating portion may come in contact with each other. Since the pores have an electrical insulating property, the pores coming in contact with the electrical insulating portion serve as a part of the electrical insulating portion together with the electrical insulating portion, thereby affecting a potential of a surface of the electrical insulating portion when the electrical insulating portion is charged.

When the pores coming in contact with the electrical insulating portion are collapsed and deformed by a contact pressure with an electrophotographic photosensitive member or the like, a potential of the surface of the electrical insulating portion coming in contact with the pores is fluctuated with a deformation amount thereof. A development amount of the toner from the developing member to the electrophotographic photosensitive member is determined by a potential difference between the developing member and the electrophotographic photosensitive member. For this reason, in the vicinity of the electrical insulating portion coming in contact with the pore, the development amount of the toner is fluctuated with the potential fluctuation, such that the black spots may be generated. In the developing member according to the present disclosure, it is possible to prevent a contact between the pores of the porous layer and the electrical insulating portion as described above by forming the electroconductive solid layer between the porous layer and the electrical insulating portion, such that it is possible to suppress black spots in the image from being generated.

In addition, the outer surface of the electroconductive solid layer can constitute an electroconductive second region. For example, in the case in which an electrical insulating portion 4 having a convex shape is formed on the outer surface of the electroconductive solid layer 3 as illustrated in FIG. 1A, the outer surface of the electroconductive solid layer 3 constitutes an electroconductive second region 7. Further, in the case of mixing electrical insulating particles in the electroconductive solid layer and exposing these particles by abrasing the outer surface of the electroconductive solid layer, or the like, as illustrated in FIG. 1B or 1C, the outer surface of the electroconductive solid layer constitutes the electroconductive second region 7.

The electroconductive solid layer contains an elastic material such as a resin or rubber. Specific examples of the resin used in the electroconductive solid layer are as follows:

polyamide, nylon, a polyurethane resin, a urea resin, polyimide, a melamine resin, a fluorine resin, a phenol resin, an alkyd resin, polyester, polyether, an acrylic resin, and mixtures thereof.

Further, specific examples of the rubber used in the electroconductive solid layer are as follows:

ethylene-propylene-diene copolymer rubber (EPDM), acrylonitrile-butadiene rubber (NBR), chloroprene rubber (CR), natural rubber (NR), isoprene rubber (IR), styrene-butadiene rubber (SBR), fluororubber, silicone rubber, epichlorohydrin rubber, and hydrides of NBR. Among them, the polyurethane resin is preferable in that it has excellent friction charging performance to the toner, and can easily get a chance to contact with the toner due to excellent flexibility and have excellent abrasion resistance.

The polyurethane resin can be obtained from polyol and isocyanate, and if necessary, a chain extender can be used. Examples of the polyol, a raw material of the polyurethane resin, can include polyether polyol, polyester polyol, polycarbonate polyol, polyolefin polyol, acrylic polyol, and mixtures thereof. Examples of the isocyanate, a raw material of the polyurethane resin, are as follows: tolylene diisocyanate (TDI), diphenylmethane diisocyanate (MDI), naphthalene diisocyanate (NDI), tolidine diisocyanate (TODI), hexamethylene diisocyanate (HDI), isophorone diisocyanate (IPDI), phenylene diisocyanate (PPDI), xylylene diisocyanate (XDI), tetramethylxylylene diisocyanate (TMXDI), cyclohexane diisocyanate, and mixtures thereof. Examples of the chain extender, a raw material of the polyurethane resin, can include bifunctional low molecular weight diols such as ethylene glycol, 1,4-butanediol, and 3-methanediol, trifunctional low molecular weight triols such as trimethylolpropane, and mixtures thereof.

Further, the electroconductive solid layer can have electroconductivity by blending an electroconductivity imparting agent (electroconductive agent) such as an electron conductive material or ion conductive material with the elastic material. Examples of the electron conductive material can include the following materials: electroconductive carbon, for example, carbon black such as ketjen black EC and acetylene black; carbon black for rubber such as super abrasion furnace (SAF), intermediate SAF (ISAF), high abrasion furnace (HAF), fast extruding furnace (FEF), general purpose furnace (GPF), semi-reinforcing furnace (SRF), fine thermal (FT), and medium thermal (MT); oxidized carbon for color (ink); and metals such as copper, silver, germanium, and metal oxides thereof.

Among them, the electroconductive carbon is preferable since it is possible to control electroconductivity with a small amount. Examples of the ion conductive material can include the following materials: inorganic ion conductive materials such as sodium perchlorate, lithium perchlorate, calcium perchlorate and lithium chloride; and organic ion conductive materials such as modified aliphatic dimethyl ammonium ethosulfate and stearyl ammonium acetate.

In the electroconductive solid layer, a blending amount of the electroconductive agent is preferably 5 to 30 parts by mass based on 100 parts by mass of the elastic material. When the blending amount of the electroconductive agent is within the above-mentioned range, volume resistivity can be optimized.

In addition, particles for imparting suitable roughness to the developing member may be contained in the electroconductive solid layer. As the particles, particles made of a resin such as a polyurethane resin, polyester, polyether, polyamide, an acrylic resin, or polycarbonate can be used. Among them, polyurethane resin particles are preferable since the polyurethane resin particles are flexible and thus are effective for resistance against toner contamination.

In addition, if necessary, various additives such a filler, particles used for other purposes except for imparting roughness, a plasticizer, a bulking agent, a vulcanizing agent, a vulcanizing aid, and a crosslinking aid, a curing inhibitor, an antioxidant, an antiaging agent, a processing aid, and a surface modifier can be contained in the electroconductive solid layer. These optional components can be blended in an amount in which functions of the electroconductive solid layer are not inhibited.

Examples of the filler can include silica, quartz powder, and calcium carbonate.

The mixing of respective materials of the electroconductive solid layer can be performed using a mixing device such as a uniaxial continuous kneader, a biaxial continuous kneader, a static mixer, or the like, or a dispersing device such as a beads mill, or the like, depending on used raw materials.

As a formation method of the electroconductive solid layer, a molding method such as an extrusion molding method, an injection molding method, or the like or a coating method such as a dip coating method, a roll coating method, a spray coating method, or the like, can be used depending on the used raw materials. In the case in which the electroconductive solid layer has a laminated structure of two or more layers, in order to improve close adhesion, a surface of an elastic layer (lower layer) adjacent to the substrate may be abrased, and may also be modified by a surface modification method such as corona treatment, flame treatment, or excimer treatment.

It is preferable that a thickness of the electroconductive solid layer be 5 μm or more and 300 μm or less. When the thickness is 5 μm or more, it is easy to suppress fine pressure fluctuation derived from the pore in the vicinity of the surface of the porous layer, and when the thickness is 300 μm or less, it is easy to decrease pressure fluctuation accompanying distortion of the electroconductive solid layer.

The thickness of the electroconductive solid layer is more preferably 50 μm or more and 160 μm or less.

In the case in which the electroconductive solid layer on the porous layer 2 is formed of one or more layers as illustrated in FIG. 1C, it is preferable that a sum of thicknesses of plural layers be within the above-mentioned range.

In the case in which a phase-separated film is provided on the electroconductive solid layer 3 as illustrated in FIG. 1D, it is preferable that a sum of thicknesses of the electroconductive solid layer and the film be within the above-mentioned range. The thickness of the electroconductive solid layer and the sum of the thicknesses of the electroconductive solid layer and the film can be measured by a method described in Examples.

Further, it is preferable that an elastic modulus of the electroconductive solid layer be 10 MPa or more and 100 MPa or less. When the elastic modulus is 10 MPa or more, it is easy to suppress fine pressure fluctuation derived from the pore in the vicinity of the surface of the porous layer, and when the elastic modulus is 100 MPa or less, it is easy to decrease pressure fluctuation accompanying distortion of the solid layer. The elastic modulus of the electroconductive solid layer can be measured by a method described in Examples.

Further, it is preferable that volume resistivity of the electroconductive solid layer be $1\times10^5$ Ω·cm or more and $1\times10^{11}$ Ω·cm or less. When the volume resistivity is $1\times10^5$ Ω·cm or more, it is easy to suitably maintain a charging amount by preventing leakage of charges of the toner, and when the volume resistivity is $1\times10^{11}$ Ω·cm or less, it is easy to generate a suitable development electric field on the surface of the developing member. The volume resistivity of the electroconductive solid layer can be measured by a method described in Examples.

<Electrical Insulating Portion>

The electrical insulating portion constitutes the electrical insulating first region.

The electrical insulating portion is charged by friction with the toner mainly at the contact portion with the toner regulating member, and a local potential difference is generated between the first region formed by the charged electrical insulating portion and the second region that is adjacent to the first region and is not charged due to electroconductivity.

In the case in which there is a local potential difference, a gradient is generated in an electric field by this potential difference. When the toner is present in the electric field in which the gradient is present, polarization generated in the toner is biased, such that a force (gradient force) accompanying the biased polarization is applied.

The developing member having a local potential difference on the surface as described above can adsorb the toner by generating a gradient force on the toner in the vicinity thereof, thereby exhibiting an excellent toner conveyance force. For this reason, the electrical insulating portion is charged quickly, which is important for suppressing a lack of a density of a black solid image at the first sheet output from the standby state and suppressing a density change between a halftone image at the first sheet output from the standby state and a halftone image at the time of outputting several sheets.

Further, the electrical insulating portion indicates a portion constituting the electrical insulating first region, that is, a portion of the outer surface of the developing member. Therefore, an electrical insulating material that is not exposed to the outer surface of the developing member, for example, the electrical insulating particles contained in the electroconductive solid layer is distinguished from the electrical insulating portion according to the present disclosure.

Examples of a material constituting the electrical insulating portion can include a resin, a metal oxide, and the like. Among them, the resin is preferable in that it is easy for the resin to be a material having a high electrical insulating property and a low relative dielectric constant and it is easy to rapidly charge the electrical insulating portion.

Specific examples of the resin applied to the electrical insulating portion are as follows: an acrylic resin, a polyolefin resin, an epoxy resin, a polyester resin, a fluorine resin, a polystyrene resin, a polyethylene resin, and a polyurethane resin.

Among these resins, the acrylic resin is preferably used in view of charge imparting property to the toner.

Examples of the acrylic resin as described above can include a methacylic copolymer containing polymethacylic acid ester such as polymethyl methacrylate and a methacrylic acid ester unit such as methyl methacrylate as main components. A specific example of the methacrylic copolymer can include a copolymer of methyl methacrylate and a copolymerizable vinyl monomer.

Examples of the copolymerizable vinyl monomer can include methyl acrylate, ethyl(meth)acrylate, n-propyl (meth)acrylate, isopropyl(meth)acrylate, n-butyl(meth)acrylate, isobutyl(meth)acrylate, t-butyl(meth)acrylate, cyclohexyl(meth)acrylate, n-octyl(meth)acrylate, isooctyl(meth) acrylate, phenyl(meth)acrylate, benzyl(meth)acrylate, butadiene(meth)acrylate, ethylene glycol dimethacrylate, ethylhexyl(meth)acrylate, 2-hydroxyethyl(meth)acrylate, a 1,3-butylene glycol di(meth)acrylate, a 1,4-butanediol di(meth)acrylate, a 1,6-hexanediol di(meth)acrylate, a neopentyl glycol di(meth)acrylate, a 1,9-nonanediol di(meth) acrylate, a 1,10-decanediol di(meth)acrylate, an ethoxylated hexanediol di(meth)acrylate, a propoxylated hexanediol di(meth)acrylate, a propoxylated neopentyl glycol di(meth) acrylate, a polyethylene glycol di(meth)acrylate, a polypropylene glycol di(meth)acrylate, a polytetramethylene glycol di(meth)acrylate, a neopentylglycol hydroxypivalate diacrylate, trimethylol propane triacrylate, ethoxylated trimethylol propane triacrylate, propoxylated trimethylol propane triacrylate, ethoxylated glycerin triacrylate, propoxylated glycerin triacrylate.

As a barometer of insulation of the electrical insulating portion, the volume resistivity of the electrical insulating portion is preferably $1.0\times10^{13}$ Ω·cm or more and $1.0\times10^{18}$ Ω·cm or less, and more preferably $1\times10^{14}$ Ω·cm or more and $1\times10^{17}$ Ω·cm or less.

When the volume resistivity of the electrical insulating portion is within the above-mentioned range, it is easy to rapidly charge the electrical insulating portion. Further, the volume resistivity of the electrical insulating portion can be measured by a method described in Examples.

A ratio of an area of a surface of the first region occupying the surface of the developing member (hereinafter, also referred to as an "occupancy ratio $R_E$") is preferably 10% or more and 60% or less. The occupancy ratio $R_E$ is more preferably 20% or more and 50% or less. It is possible to make a toner conveyance force by the developing member suitable by setting the occupancy ratio $R_E$ within the above-mentioned range. Further, the occupancy ratio $R_E$ can be measured by a method described in Examples.

Further, it is more preferable that in the first region constituted by the electrical insulating portion, a convex portion be formed on the surface of the developing member. By setting the first region to such a configuration, a decrease in the density of the black solid image at the time of performing the first sheet output from a standby state of an image forming apparatus is further suppressed. In the case in which the convex portion is formed on the outer surface of the developing member in the electrical insulating portion, when the toner collides with the electrical insulating portion, the toner is rolled in a lateral direction with respect to a rotation direction. In the developing member according to the present disclosure, since the pressure at the nip portion between the toner regulating member and the developing member is constant, it is thought that the movement of the toner in the lateral direction continues and a friction chance increases synergistically. Therefore, it is estimated that the first region has the convex portion formed on the outer surface of the developing member, such that a lack of the density of the black solid image at the first sheet output from the standby state or a density change between a halftone image at the first sheet output from the standby state and a halftone image at the time of outputting several sheets is more suppressed.

A height of the convex portion of the first region is not particularly limited, but it is preferable that the height of the convex portion be 0.5 μm or more and 10.0 μm or less in an outer peripheral direction of a cross section based on the electroconductive solid layer or the electroconductive portion on the outer surface as a reference surface. It is easy for the toner to collide with the first region corresponding to the electrical insulating portion by setting the height of the convex portion to 0.5 μm or more, and it is easy for the toner to roll in the nip portion by setting the height to 10.0 μm or less. A more preferable height is 1.0 μm or more and 3.0 μm or less. Further, the height of the convex portion of the first region can be measured by a method described in Examples.

As a method of forming the electrical insulating portion, for example, the following methods can be mentioned.

A method of mixing components constituting the electrical insulating portion and the electroconductive solid layer or the electroconductive portion with each other and separating phases under suitable conditions.

A method of mixing electrical insulating particles in the electroconductive solid layer and abrasing the surface of the electroconductive solid layer to expose the electrical insulating particles.

A method of printing components constituting the electrical insulating portion disposed on the electroconductive solid layer using various printing methods to form the electrical insulating portion.

A method of coating (spraying, dipping, or the like) a component solution constituting the electrical insulating portion disposed on the electroconductive solid layer and sputtering to form the electrical insulating portion. Among them, in an inkjet method, which is one of the various printing methods, it is possible to easily form the convex portion by pattern-printing the electrical insulating portion disposed on the electroconductive solid layer formed in advance.

<Electroconductive Portion>

In the case in which the phase-separated film is formed on the electroconductive solid layer 3 as in the configuration illustrated in FIG. 1D, the electrical insulating portion 4 comes in contact with the electroconductive solid layer 3 below. Further, in the film, a section phase-separated from the electrical insulating portion 4 is a section constituting the second region 7. In the present disclosure, this section is referred to as an electroconductive portion 5.

The electroconductive portion 5 is distinguished from the electroconductive solid layer 3 interposed between the porous layer 2 and the electrical insulating portion 4. In addition, the outer surface of the electroconductive portion 5 constitutes the electroconductive second region 7.

Further, it is preferable that volume resistivity of the electroconductive portion be $1.0\times10^5$ Ω·cm or more and $1.0\times10^{11}$ Ω·cm or less. When the volume resistivity of the electroconductive portion is within the above range, the charge can be sufficiently removed. Further, the volume resistivity of the electroconductive portion can be measured by a method described in Examples. The electroconductive portion as described above can be prepared, for example, by forming a film in which an electrical insulating resin and an electroconductive resin are phase-separated.

In addition, a material capable of being used in the electroconductive portion, a mixing method, or a formation method of the electroconductive portion can be the same as that of the electroconductive solid layer.

Further, since the electroconductive portion is formed on the electroconductive solid layer and serves to suppress depression of the pores together with the electroconductive solid layer, it is preferable to adjust a sum of thicknesses of the electroconductive solid layer and the electroconductive portion so as to be 5 μm or more and 300 μm or less.

In addition, an elastic modulus, a thickness, or volume resistivity of the electroconductive portion can be calculated by the same methods as methods of measuring the elastic modulus, the thickness, and the volume resistivity of the electroconductive solid layer described above except that a cut portion is the electroconductive portion.

[Electrophotographic Process Cartridge and Electrophotographic Image Forming Apparatus]

An electrophotographic process cartridge at least includes: a toner container including a toner so as to be detachably attachable to a main body of an electrophotographic image forming apparatus; and a developing unit that conveys the toner. In addition, as the developing unit, the developing member according to the present disclosure described above and a developer amount regulating member disposed to be in contact with an outer surface of the developing member are provided.

Further, an electrophotographic image forming apparatus is an electrophotographic image forming apparatus at least including: an electrophotographic photosensitive member; a charging unit disposed to be able to charge the electrophotographic photosensitive member; and a developing unit that supplies a toner to the electrophotographic photosensitive member, in which, as the developing unit, the developing member according to the present disclosure described above and a developer amount regulating member disposed to be in contact with an outer surface of the developing member are provided.

Hereinafter, the electrophotographic process cartridge and the electrophotographic image forming apparatus will be described in detail using the accompanying drawings.

Figure 2:
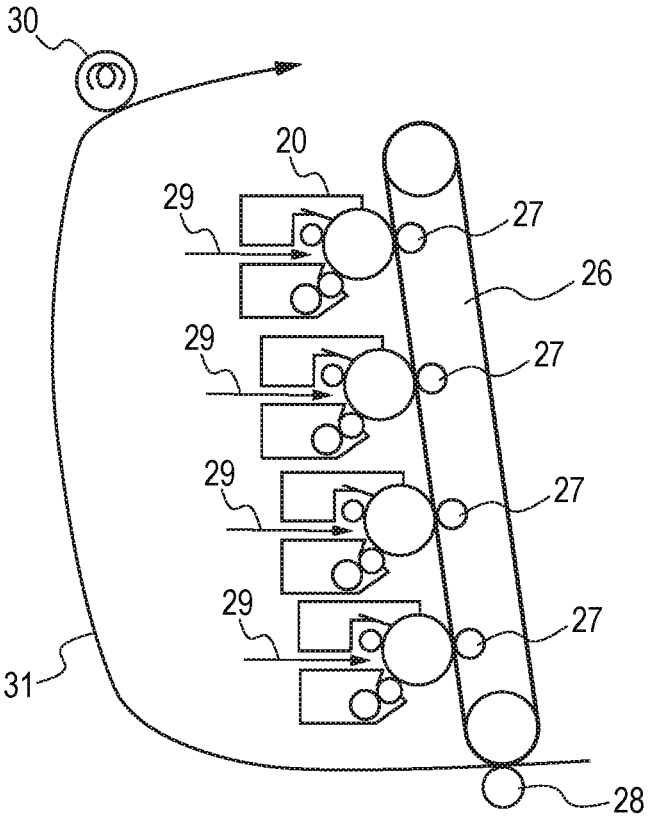
FIG. 2 is a schematic configuration view illustrating an example of an electrophotographic image forming apparatus according to the present disclosure.
Figure 3:
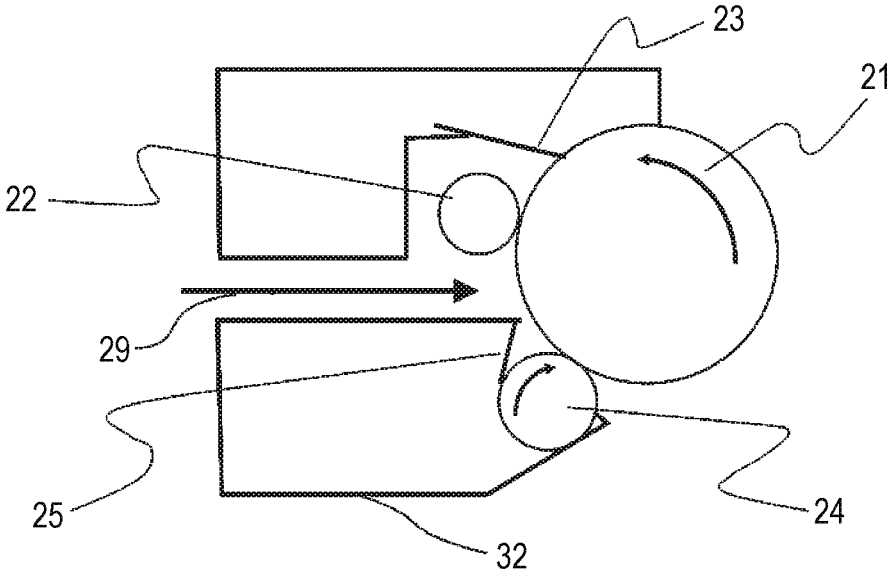
FIG. 3 is a schematic configuration view illustrating an example of an electrophotographic process cartridge according to the present disclosure.

FIG. 2 schematically illustrates an example of the electrophotographic image forming apparatus. Further, FIG. 3 schematically illustrates an example of an electrophotographic process cartridge 20 mounted in the electrophotographic image forming apparatus of FIG. 2. The electrophotographic process cartridge has an electrophotographic photosensitive member 21, a charging device including a charging member 22, a developing device including a developing member 24, and a cleaning device including a cleaning member 23. The developing device includes a toner regulating member 25, which is the developer amount regulating member, and a toner container 32 including the toner (not illustrated) in addition the developing member 24. Further, the electrophotographic process cartridge 20 is configured to be detachably attachable to the main body of the electrophotographic image forming apparatus of FIG. 2.

The electrophotographic photosensitive member 21 is uniformly charged (primarily charged) by the charging member 22 connected to a bias power supply (not illustrated). Next, the electrophotographic photosensitive member 21 is irradiated with exposure light 29 for writing an electrostatic latent image by an exposure device (not illustrated), and an electrostatic latent image is formed on the surface. As the exposure light 29, either LED light or laser light can be used.

Next, a negatively charged toner is applied (developed) to the electrostatic latent image by the developing member 24, and a toner image is formed on the electrophotographic photosensitive member 21, such that the electrostatic latent image is converted to a visible image. In this case, the developing member 24 is applied with a voltage by a bias power supply (not illustrated). Further, the developing member 24 comes in contact with an image carrier while having a nip width of, for example, 0.5 mm or more and 3 mm or less.

The toner image developed on the electrophotographic photosensitive member 21 is primarily transferred to an intermediate transfer belt 26. A primary transfer member 27 comes in contact with a back surface of the intermediate transfer belt, and a voltage is applied to the primary transfer member 27 to primarily transfer a toner image of negative polarity from the image carrier to the intermediate transfer belt 26. The primary transfer member 27 may have a roller shape or blade shape.

When the electrophotographic image forming apparatus is a full color image forming apparatus, typically, respective processes of charging, exposure, development, and primary transfer are performed with respect to respective colors of yellow, cyan, magenta and black. For this reason, in the electrophotographic image forming apparatus illustrated in FIG. 2, a total of four electrophotographic process cartridges each containing the toner of each color are detachably mounted on the main body of the electrophotographic image forming apparatus. In addition, the respective processes of charging, exposure, development, and primary transfer are sequentially performed with a predetermined time difference, and a state in which four color toner images for expressing a full color image are superimposed on the intermediate transfer belt 26 is made.

As the intermediate transfer belt 26 rotates, the toner image on the intermediate transfer belt 26 is conveyed to a position facing a secondary transfer member 28. Recording paper is conveyed along a conveyance route 31 of the recording paper between the intermediate transfer belt 26 and the secondary transfer member 28 at a predetermined timing, and the toner image on the intermediate transfer belt 26 is transferred to the recording paper by applying a secondary transfer bias to the secondary transfer member 28. The recording paper to which the toner image has been transferred by the secondary transfer member 28 is conveyed to a fixing device 30, and after the toner image on the recording paper is melted and fixed on the recording paper, the recording paper is discharged to the outside of the electrophotographic image forming apparatus, such that the printing operation is terminated.

According to one aspect of the present disclosure, a developing member capable of sufficiently increasing a density of an image initially output from the standby state can be obtained. Further, according to another aspect of the present disclosure, an electrophotographic process cartridge which contributes to stable formation of a high quality electrophotographic image can be obtained. According to still another aspect of the present disclosure, an electrophotographic image forming apparatus capable of stably forming a high quality electrophotographic image can be obtained.

EXAMPLE

Materials Used to Manufacture Developing Members According to Examples and Comparative Examples were Prepared.

«Preparation of Porous Layer Forming Material A-1»

First, 80 parts by mass of polyether polyol 1 (trade name: T-1000, manufactured by Mitsui Chemicals & SKC Polyurethanes Inc., Mw=1000) and 20 parts by mass of polyether polyol 2 (trade name: EP550N, manufactured by Mitsui Chemicals & SKC Polyurethanes Inc., Mw=3000) were mixed with each other. Next, 5 parts by mass of a cross-linking agent (trade name: trimethylolpropane, manufactured by Tokyo Chemical Industry Co., Ltd.), 1 part by mass of a silicone foam stabilizer (trade name: L-6861, manufactured by Momentive), 2 parts by mass of a catalyst (trade name: 33LV, manufactured by Evonik), 30 parts by mass of carbon black (trade name: MA100, manufactured by Mitsubishi Chemical Corp.), and 25 parts by mass of isocyanate (trade name: TM-50, manufactured by Mitsui Chemicals SKC polyurethanes Inc.) were added to this polyol mixture, thereby obtaining a porous layer forming material A-1.

«Preparation of Solid Layer Forming Material B-1»

In a reaction vessel, 100.0 parts by mass of polyether based polyol (trade name: PTG-L3500, manufactured by Hodogaya Chemical Co., Ltd.) was slowly dropped into 19.3 parts by mass of polymeric MDI (trade name: Millionate, MT, manufactured by Tosoh Corp.) under a nitrogen atmosphere. Further, a temperature in the reaction vessel was maintained at 72° C. during the dropping.

After the dropping was terminated, a reaction was carried out at 72° C. for 2 hours. The obtained reaction mixture was cooled to room temperature, thereby obtaining an isocynate group-terminated prepolymer b having an isocyanate group content of 3.1 mass %.

Then, 76.0 parts by mass of the isocyanate group-terminated prepolymer b, 24 parts by mass of polyether based polyol (trade name: PTG-L1000, manufactured by Hodogaya Chemical Co., Ltd.), 26 parts by mass of carbon black (trade name: MA100, manufactured by Mitsubishi Chemical Corp.), and 2.5 parts by mass of roughened particles (trade name: UCN5150, manufactured by Dainichiseika Color & Chemicals Mfg. Co., Ltd.) were mixed with one another.

To the obtained mixture, methyl ethyl ketone (MEK) was added so as to have a total solid content of 40 mass %. In a 450 mL glass bottle, 250 parts by mass of the obtained mixed solution and 200 parts by mass of glass beads having an average particle diameter of 0.8 mm were placed and dispersed for 30 minutes using a paint shaker (manufactured by Toyo Seiki Seisaku-sho, Ltd). Thereafter, the glass beads were removed using a mesh, thereby obtaining a solid layer forming material B-1.

Preparation of Solid Layer Forming Material B-2

An isocyanate group-terminated prepolymer a having an isocyanate content (NCO %) of 2.3% was prepared by adjusting a mixing ratio of polyether based polyol (trade name: PTG-L3500, manufactured by Hodogaya Chemical Co., Ltd.) to polymeric MDI (trade name: Millionate MT, manufactured by Tosoh Corp.). Then, a solid layer forming material B-2 was prepared in the same manner in the solid layer forming material B-1 except that materials and a mixing ratio were changed as described in Table 1-1. In addition, details of abbreviations shown in Table 1-1 were described in Table 1-2.

«Preparation of Solid Layer Forming Material B-3»

An isocyanate group-terminated prepolymer c having an isocyanate content (NCO %) of 6.5% was prepared in the same manner as in the isocyanate group-terminated prepolymer a. In addition, a solid layer forming material B-3 was prepared in the same manner in the solid layer forming material B-1 except that materials and a mixing ratio were changed as described in Table 1-1.

«Preparation of Solid Layer Forming Materials B-4 to B-7»

Solid layer forming materials B-4 to B-7 were prepared in the same manner as in the solid layer forming material B-1 except that materials and a mixing ratio were changed as described in Table 1-1.

«Preparation of Phase-Separate Resin Layer Forming Materials B-8 and B-9»

Materials described in Table 1-1 were mixed in a mixing ratio described in Table 1-1, and methyl ethyl ketone (MEK) was added thereto to adjust a total solid content to be 40 mass %, thereby obtaining a mixed solution. In a 450 mL glass bottle, 250 parts by mass of the obtained mixed solution and 200 parts by mass of glass beads having an average particle diameter of 0.8 mm were placed and dispersed for 30 minutes using a paint shaker (manufactured by Toyo Seiki Seisaku-sho, Ltd). Thereafter, the glass beads were removed, thereby obtaining phase-separated resin layer forming materials B-8 and B-9.

TABLE 1-1

| | | Solid Layer Forming Material No. | | | | | | | Phase-separated Resin Layer Forming Material No. | |
|---|---|---|---|---|---|---|---|---|---|---|
| | | B-1 | B-2 | B-3 | B-4 | B-5 | B-6 | B-7 | B-8 | B-9 |
| Raw Material 1 | Abbreviation | Bc-2 | Bc-1 | Bc-3 | Bc-2 | Bc-2 | Bc-2 | Bc-2 | Bc-2 | Bc-2 |
| | Mixing Amount (Parts by Mass) | 76 | 56 | 60 | 76 | 76 | 76 | 76 | 76 | 76 |
| Raw Material 2 | Abbreviation | Ba-1 | Ba-1 | Ba-3 | Ba-1 | Ba-1 | Ba-1 | Ba-1 | Ba-1 | Ba-1 |
| | Mixing Amount (Parts by Mass) | 24 | 44 | 40 | 24 | 24 | 24 | 24 | 24 | 24 |
| Electroconductive Material | Abbreviation | Bd-1 | Bd-1 | Bd-1 | Bd-1 | Bd-1 | Bd-1 | Bd-1 | Bd-1 | Bd-1 |
| | Mixing Amount (Parts by Mass) | 26 | 26 | 26 | 5 | 26 | 26 | 26 | 26 | 5 |
| Resin Particle 1 | Abbreviation | Be-1 | Be-1 | Be-1 | Be-1 | — | Be-1 | Be-1 | Be-1 | Be-1 |
| | Mixing Amount (Parts by Mass) | 2.5 | 2.5 | 2.5 | 2.5 | — | 2.5 | 2.5 | 2.5 | 2.5 |

TABLE 1-1-continued

| | | Solid Layer Forming Material No. | | | | | | | Phase-separated Resin Layer Forming Material No. | |
|---|---|---|---|---|---|---|---|---|---|---|
| | | B-1 | B-2 | B-3 | B-4 | B-5 | B-6 | B-7 | B-8 | B-9 |
| Resin Particle 2 | Abbreviation | — | — | — | — | — | Bf-1 | Bg-1 | — | — |
| | Mixing Amount (Parts by Mass) | — | — | — | — | — | 30 | 30 | — | — |
| Resin Particle 3 | Abbreviation | — | — | — | — | — | — | — | Ce-1 | Ce-1 |
| | Mixing Amount (Parts by Mass) | — | — | — | — | — | — | — | 30 | 30 |

Details of the materials represented by respective abbreviations in Table 1-1 were described in Table 1-2.

TABLE 1-2

| Kind | Material |
|---|---|
| Ba-1 | Polyol (Trade Name: PTG-L3500, Hodogaya Chemical Co., Ltd.) |
| Ba-2 | Polyol (Trade Name: PTG-L1000, Hodogaya Chemical Co., Ltd.) |
| Ba-3 | Polyol (Trade Name: NIPPOLAN 4002, Tosoh Corp.) |
| Bc-1 | Prepolymer a (NCO %: 2.3) |
| Bc-2 | Prepolymer b (NCO %: 3.1) |
| Bc-3 | Prepolymer c (NCO %: 6.5) |
| Bd-1 | Carbon Black (Trade Name: MA100 Mitsubishi Chemical Corp.) |
| Be-1 | Urethane Resin Particles (Trade Name: UCN5150 (Average Particle Diameter: 15 μm), Dainichiseika Color & Chemicals Mfg. Co., Ltd) |
| Bf-1 | Acrylic Resin Particles (Trade Name: MX1500H (Average Particle Diameter: 15 μm), Soken Chemical & Engineering Co., Ltd.) |
| Bg-1 | Fluoride Resin Particles (Trade Name: Lubricant L169J (Average Particle Diameter: 17 μm), AGC) |
| Ca-1 | Polybutadiene methacylate (Trade Name: EMA-3000, Nippon Soda Co., Ltd.) |
| Cb-1 | Ethylene Glycol Dimethacrylate (Trade Name: SR206, Tomoe Engineering Co., Ltd.) |
| Cc-1 | Isooctyl Acrylate (Trade Name: Trade Name: SR440, Tomoe Engineering Co., Ltd.) |
| Cd-1 | Polymerization Initiator (Trade Name: IRGACURE 184, BASF) |
| Ce-1 | Polyester Resin Particles (Trade Name: VYLON 200 Pellets, TOYOBO Co., Ltd.) |

«Preparation of Electrical Insulating Portion Forming Material C-1»

An electrical insulating portion forming material C-1 was obtained by mixing 50 parts by mass of polybutadiene methacrylate (trade name: EMA-3000, manufactured by Nippon Soda Co., Ltd.) and 50 parts by weight of isooctyl acrylate (trade name: SR440, manufactured by Tomoe Engineering Co., Ltd.), and 5 parts by mass of 1-hydroxycyclohexyl phenyl ketone (trade name: IRGACURE 184, manufactured by BASF) as a photoinitiator with one another.

«Preparation of Electrical Insulating Portion Forming Material C-2»

An electrical insulating portion forming material C-2 was prepared in the same manner as in the electrical insulating portion forming material C-1 except that a material and a mixing ratio were changed as shown in Table 2.

TABLE 2

| | Electrical Insulating Portion | | | | | |
|---|---|---|---|---|---|---|
| | Raw Material 1 | | Raw Material 2 | | Raw Material 3 | |
| | Abbreviation | Mixing Amount (Parts by Mass) | Abbreviation | Mixing Amount (Parts by Mass) | Abbreviation | Mixing Amount (Parts by Mass) |
| C-1 | Ca-1 | 50 | Cc-1 | 50 | Cd-1 | 5 |
| C-2 | Cb-1 | 100 | — | — | Cd-1 | 5 |

Example 1

<1. Formation of Porous Roller>

The porous layer forming material A-1 was injected into a mechanical froth casting machine, and nitrogen gas as an inert gas was blown therein while mixing and stirring at a speed of 1000 rpm in a mixing head of the casting machine. Here, an amount of the blown nitrogen gas was suitably adjusted so that a porosity became 33% at the time of forming a porous layer to be described below.

A cylindrical substrate made of stainless steel (SUS304) having an outer diameter of 6 mm and a length of 269.0 mm was attached to the inside of a mold and preheated to a temperature of 70° C. in advance. The porous layer forming material A-1 into which nitrogen gas was blown was injected into the mold above. Then, the mold was maintained at 70° C. for 10 minutes to cure the porous layer forming material A-1 and form a porous layer having a thickness of 1.99 mm on an outer periphery of the substrate, thereby obtaining a porous roller.

«2. Formation of Solid Layer»

A layer of the solid layer forming material B-1 was formed on an outer surface of the porous layer by immersing the porous roller in the solid layer forming material B-1 while holding an upper end portion of the substrate in a state in which a longitudinal direction of the porous roller became a vertical direction and then pulling the porous roller up. An immersion time was 9 seconds, and an initial pulling speed from a coating solution was 30 mm/s, a final pulling speed was 20 mm/s, and the speed was changed linearly with time therebetween.

The porous roller in which the layer of the solid layer forming material B-1 was formed on the porous layer was dried in an oven at a temperature of 80° C. for 15 minutes. Continuously, the porous roller was heated at a temperature of 140° C. for 2 hours to cure the layer of the solid layer forming material B-1, thereby forming the solid layer on the porous layer. A film thickness of the solid layer was measured, and the measured film thickness was 95

<3. Formation of Electrical Insulating Portion>

The porous roller having the solid layer was set on a jig capable of rotating a roller in a circumferential direction. While rotating the set roller, a droplet of the electrical insulating portion forming material C-1 was attached to an outer peripheral surface of the solid layer using a piezoelectric inkjet head (trade name: NANO MASTER SMP-3, manufactured by Musashi Engineering Inc.). A droplet amount of one drop from the ink jet head was adjusted to 15 pl. Further, landing positions of the droplets were controlled such that intervals (center-to-center distances) between dots attached on the solid layer in the circumferential direction and the longitudinal direction were each 75 μm pitches.

Thereafter, using a low-pressure mercury lamp, ultraviolet light was irradiated for 10 minutes so as to have a wavelength of 254 nm and an integrated light quantity of 1500 mJ/cm$^2$ to cure the electrical insulating portion forming material C-1, thereby forming an electrical insulating portion as a first region. In this way, a developing roller 1 having an outer diameter of 12.0 mm in which a surface of the solid layer was a second region was obtained.

Evaluation of Characteristics of Developing Roller 1

With respect to the developing roller 1, a porosity, a cell diameter, a thickness of the solid layer, an elastic modulus, volume resistivity, an occupancy ratio, and a height and volume resistivity of the electrical insulating portion were measured by the following methods, respectively.

«Evaluation 1: Method of Measuring Porosity»

A sample was cut from a portion of the porous layer in a shape of a square having a length of 5 mm and a width of 5 mm.

The cut sample was observed using an objective lens with a magnification of 20 times in a laser microscope (trade name: VK-X100, manufactured by Keyence Corp.). The observed image was binarized, and a value calculated by converting a value obtained by dividing an area of pores with an area 100% into a total area (square having a length of 5 mm and a width of 5 mm) as determined as the porosity. As a result, the porosity of the developing roller 1 was 33%.

«Evaluation 2: Method of Measuring Cell Diameter»

Samples of 10 pieces were cut from the porous layer at equal intervals in the longitudinal direction of the roller, and cells of each cut sample were observed using an objective lens with a magnification of 20 times installed in a laser microscope (trade name: VK-X100, manufactured by Keyence Corp). The largest cell diameter in the observed range was determined as the cell diameter of the developing roller. As a result, the cell diameter of the developing roller 1 was 95 μm.

«Method of Measuring Thickness of Solid Layer»

A sample was cut from the developing roller. In detail, samples were taken from a total of nine positions at intervals of 120° in the circumferential direction from the portions at 10 mm from both ends in the longitudinal direction and one portion at the central portion. Respective samples cut from these nine positions were measured using a laser microscope (trade name: VKX100, manufactured by Keyence Corp.). Film thicknesses of the electroconductive solid layer randomly at 10 points at each measurement position were measured. An arithmetic average value of the obtained 90 points in total was calculated, and this value was determined as the thickness of the solid layer. As a result, the thickness of the solid layer of the developing roller 1 was 95 μm.

«Evaluation 3: Method of Measuring Elastic Modulus»

The elastic modulus of the solid layer was measured using a nano indenter measurement apparatus (trade name: FISHER scope HM2000, manufactured by Fischer Instruments K.K.) adopting a nano-indentation method.

The nano-indentation method is a method of measuring a relationship between a load and displacement until an indenter is removed (unloaded) after the indenter made of diamond is loaded into the sample surface to a certain load (press-in). A loading curve obtained at this time reflects an elasto-plastic deformation behavior of the material, and an unloading curve reflects an elastic recovery behavior. Therefore, an elastic modulus can be calculated from an initial inclination of the unloading curve.

The measurement was performed according to the following procedure.

After the surface of the developing roller was cut in a size of 5 mm square and 2 mm in thickness in a state in which the developing roller had the solid layer and cut with a microtome, thereby preparing a sample in which the cross section of s surface layer was leveled. Next, a temperature of the sample was controlled to 23° C. and a relative humidity of 50% using the nano-indentation measurement apparatus. Thereafter, in this sample, the portion where the resin particles and the electrical insulating portion were not present on the surface was measured at three points, and an arithmetic average value of the obtained measurement results was calculated as the elastic modulus of the electroconductive solid layer of the developing roller. In addition, at the time of measurement, a loading amount of the indentator to the surface of the sample was 300 nm. As a result, the elastic modulus of the solid layer of the developing roller 1 was 30 MPa.

«Evaluation 4: Method of Measuring Volume Resistivity of Electrical Insulating Portion and Electroconductive Portion»

A sample was cut out from the developing roller, and a thin sample having a plane size of 50 μm square and a thickness t of 100 nm was prepared with a microtome. Next, the thin sample was placed on a metal flat plate, and the thin sample was pressed from above using a metal terminal of which an area S of a pressing surface was 100 μm$^2$.

In this state, resistance R was determined by applying a voltage of 1 V between the metal terminal and the metal plate using an electrometer (trade name: 6517B, manufactured by KEITHLEY). Volume resistivity pv was calculated from the resistance R using the following Calculation Equation (1).

$$pv = R \times S/t \qquad \text{Calculation Equation (1)}$$

«Evaluation 5: Method of Measuring of Occupancy Ratio $R_E$ of First Region»

The occupancy ratio $R_E$ of the first region was measured as follows.

An objective lens with a magnification of 20 times was installed in a laser microscope (trade name: VK-X100, manufactured by Keyence Corp.). Then, the surface of the developing roller was photographed at a total of nine regions in two positions 10 mm inside from the both end portions and one position in a central portion in the longitudinal direction of the developing roller at each three positions in the circumferential direction (intervals of 120°), and connection of photographed images was performed so that one side became 900 μm.

Next, an inclination of the obtained observation image was corrected in a quadratic surface correction mode. In the center of the corrected image, an area occupied by the first region in an area of a square of 900 μm on one side was measured. The measurement was performed using an image processing software such as ImageJ, or the like. A value obtained by dividing the area occupied by the first region within the area of the square of 900 μm on one side was determined as the occupancy ratio $R_E$ in this area.

An arithmetic average value of the occupancy ratios $R_E$ obtained at nine regions was calculated and determined as an occupancy ratio $R_E$ of the developing roller 1.

«Evaluation 6: Method of Measuring of Height of First Region»

The height of the first region constituted by the electrical insulating portion was measured using the image corrected for inclination as in the measurement of the occupancy ratio $R_E$.

Using the obtained three-dimensional observation image, a difference 'H1−H2' between a highest height H1 of the first region and a height H2 of a position of the second region adjacent to the first region in the second region having an electroconductive surface was calculated. An arithmetic average value of differences 'H1−H2' obtained at 9 regions was determined as the height of the first region.

«Evaluation 7: Confirmation of Presence of First and Second Regions and Calculation of Potential Decay Time Constant of Each Region»

First, the presence of the first area and the second regions could be confirmed by observing the presence of two or more regions on the outer surface of the developing roller using an optical microscope, a scanning electron microscope, or the like.

In addition, it could be confirmed by the following method that the first region was electrical insulating and the second region had higher electroconductivity than that of the first region. That is, this could be confirmed by measuring residual potential distribution after charging the outer surface of the developing roller including the first region and the second region in addition to the volume resistivity.

The residual potential distribution can be confirmed by the following steps, first, sufficiently charging the outer surface of the developing roller with a charging device such as a corona discharger, and thereafter, measuring the residual potential distribution of the outer surface of the charged developing roller with such as an electrostatic force microscope (EFM) and a surface potential microscope (KFM).

An electrical insulating property of the electrical insulating portion constituting the first region and electroconductivity of the electroconductive solid layer and the electroconductive portion constituting the second region could be also evaluated by a potential decay time constant in addition to the volume resistivity. The potential decay time constant, which is defined as a time required until a surface potential (residual potential) decays to $V_0 \times (1/e)$ when the first region or the second region is charged to $V_0$ (V), becomes an index of the ease of holding the charged potential. Here, e is the base of natural logarithms. When the potential decay time constant of the first region is 60.0 seconds or more, the electrical insulating portion is rapidly charged, and a potential by the charging can be easily maintained, which is preferable. In addition, the potential decay time constant of the second region is less than 6.0 seconds, which is preferable in that charging of the solid layer and the electroconductive portion is suppressed, such that it is easy to generate a potential difference between the charged electrical insulating portion and the electroconductive layer and it is easy to express a gradient force. In measuring the time constant in the present disclosure, in the case in which the residual potential was approximately 0 V at a measurement start timing in the following measurement method, that is, in the case in which the potential has decayed at the measurement start timing, the time constant of the measurement point was considered to be less than 6.0 seconds. The potential decay time constant can be obtained by sufficiently charging the outer surface of the developing roller, for example, using a charging device such as a corona discharging device and then measuring a time-dependent change in the residual potentials of the first region and the second region of charged developing roller using an electrostatic force microscope (EFM).

(Method of Observing Outer Surface of Developing Roller)

Hereinafter, an example of a method of observing the outer surface of the developing roller is described.

First, the outer surface of the developing roller was observed using an optical microscope (VHX5000 (product name), manufactured by Keyence Corp.), and it was confirmed that two or more regions were present in the outer surface. Next, a thin piece including the outer surface of the developing roller was cut out from the developing roller using a cryomicrotome (UC-6 (product name), manufactured by Leica Microsystems). The thin piece having a size of 100 μm×100 μm on and having a thickness of 1 μm based on the outer surface of the electroconductive solid layer was cut out from the outer surface of the developing roller at a temperature of −150° C. so as to include two or more regions on the outer surface of the developing roller. Then, the outer surface of the developing roller on the cut thin piece was observed using the optical microscope.

(Method of Measuring Residual Potential Distribution)

Hereinafter, an example of the method of measuring the residual potential distribution is described.

The residual potential distribution was measured by corona-charging the outer surface of the developing roller on the thin piece with a corona discharging device, and then measuring the residual potential of the outer surface using an electrostatic force microscope (Model 1100TN, manufactured by Trek Japan Co., Ltd.) while scanning the thin piece.

First, the thin piece was placed on a smooth silicon wafer so that a surface including the outer surface of the developing roller was an upper surface, and was allowed to stand for 24 hours in an environment of a temperature of 23° C. and a relative humidity of 50%. Then, in the same environment, the silicon wafer loaded with the thin piece was placed on a high-precision XY stage incorporated in the electrostatic force microscope. The corona discharging device in which a distance between a wire and a grid electrode was 8 mm was used. The corona discharging device was placed at a position where a distance between the grid electrode and a surface of the silicon wafer surface was 2 mm. Then, the silicon wafer was grounded, a voltage of −5 kV was applied to the wire and a voltage of −0.5 kV was applied to the grid electrode using an external power supply. After starting the application, the outer surface of the developing roller on the thin piece was corona-charged by scanning at a speed of 20 mm/sec parallel to the surface of the silicon wafer using the high-precision XY stage so that the thin piece passed right below the corona discharging device.

Subsequently, the thin piece was moved right below a cantilever of the electrostatic force microscope using the high-precision XY stage. Then, the residual potential distribution was measured by measuring the residual potential of the outer surface of the corona-charged developing roller while scanning using the high-precision XY stage. Measurement conditions are shown below.

- Measurement condition: temperature of 23° C. and relative humidity of 50%
- Time to start measurement after the measurement point passed right below the corona discharging device: 60 seconds
- Cantilever: cantilever for Model 1100TN (model number; Model 1100TNC-N, manufactured by Trek Japan Co., Ltd.)
- Gap between measurement surface and cantilever tip: 10 μm
- Measurement range: 99 μm×99 μm
- Measurement interval: 3 μm×3 μm By confirming the presence or absence of residual potential in two or more regions present on the thin piece from the residual potential distribution obtained by the measurement, whether each region was an electrical insulating first region or the second region having higher electroconductivity than that of the first region was confirmed. More specifically, among the two or more regions, a region including a portion where an absolute value of the residual potential was less than 1 V was determined as the second region, and a region including a portion where an absolute value of the residual potential was larger than the absolute value of the residual potential of the second region by 1 V or more was determined as the first region, and the presence thereof was confirmed.

In addition, the method of measuring the residual potential distribution is provided by way of example, and a device and conditions suitable for confirming the presence or absence of the residual potential of the two or more regions may be changed depending on the size, interval, time constant, and the like, of the electrical insulating portion or the electroconductive layer.

(Method of Measuring Potential Decay Time Constant)

Hereinafter, an example of the method of measuring a potential decay time constant is described.

The potential decay time constant was calculated by first, corona-charging the outer surface of the developing roller with a corona discharger, then measuring a time-dependent change of the residual potential on the electrical insulating portion or on the electroconductive solid layer present on the outer surface with an electrostatic force microscope (Model 1100TN, manufactured by Trek Japan Co., Ltd.) and fitting the measured time-dependent change by using the following Equation (1). Here, a measurement point of the electrical insulating portion was a point where an absolute value of the residual potential was largest in the first region confirmed in the measurement of the residual potential distribution. Further, a measurement point of the electroconductive solid layer was a point where a residual potential became approximately 0 V in the second region confirmed in the measurement of the residual potential.

First, the thin piece used in the measurement of the residual potential distribution was placed on a smooth silicon wafer so that a surface including the outer surface of the developing roller was an upper surface, and allowed to stand for 24 hours in an environment of room temperature (23° C.) and relative humidity of 50%.

Then, in the same environment, the silicon wafer loaded with the thin piece was installed on a high-precision XY stage incorporated in the electrostatic force microscope. The corona discharging device in which a distance between a wire and a grid electrode was 8 mm was used. The corona discharging device was placed at a position where a distance between the grid electrode and a surface of the silicon wafer surface was 2 mm. Then, the silicon wafer was grounded, a voltage of −5 kV was applied to the wire and a voltage of −0.5 kV was applied to the grid electrode using an external power supply. After starting the application, the thin piece was corona-charged by scanning at a speed of 20 mm/sec parallel to the surface of the silicon wafer using the high-precision XY stage so that the thin piece passed right below the corona discharging device.

Subsequently, a measurement point of the electrical insulating portion or the electroconductive solid layer was moved right below the cantilever of the electrostatic force microscope using the high-precision XY stage, and a time-dependent change of the residual potential was measured. In the measurement, the electrostatic force microscope was used. Measurement conditions are shown below.

Measurement condition: temperature of 23° C. and relative humidity of 50%

Time to start measurement after the measurement point passed right below the corona discharging device: 15 seconds Cantilever: cantilever for Model 1100TN (model number: Model 1100TNC-N, manufactured by Trek Japan Co., Ltd.)

Gap between measurement surface and cantilever tip: 10 μm

Measurement frequency: 6.25 Hz

Measurement time: 1000 seconds

From the time-dependent change of the residual potential obtained by the measurement, the time constant τ was determined by fitting the following Equation (1) by a least square estimation method.

$$V_0 = V(t) \times \exp(-t/\tau) \quad (1)$$

t: elapsed time (seconds) after the measurement point passed right below the corona discharging device $V_0$: initial potential (V) (potential at t=0)

V(t): residual potential (V) at t seconds after the measurement point passed right below the corona discharging device τ: potential decay time constant (seconds)

The potential decay time constant τ was measured at a total of 9 points at 3 points in a longitudinal direction×3 points in a circumferential direction of the outer surface of the developing roller, and an average value thereof was determined as the potential decay time constant of the electrical insulating portion or the electroconductive layer. Further, in the measurement of the electroconductive solid layer, in the case of including the point at which the residual potential was approximately 0 V at the start of measurement, that is, at 15 seconds after corona charging, a time constant thereof was considered to be less than an average value of time constants of the other measurement points. In addition, when the potential at the start of measurement of all the measurement points was approximately 0 V, the time constant was considered to be less than a measurement lower limit.

«Evaluation 8: Evaluation of Image»

[1. Preparation of Electrophotographic Image Forming Apparatus]

In order to evaluate an image, an electrophotographic image forming apparatus (trade name: HP Color Laser Jet 653dn/x, manufactured by Hewlett-Packard Co.) and a dedicated process cartridge (trade name: HP 656X CF463X, manufactured by Hewlett Packard Co.) were prepared. Next, a gear of a toner supply roller was removed. The toner supply roller is driven to rotate with respect to a developing roller by removing the gear, such that a torque was reduced. In this way, a supply amount of a toner to the developing roller was decreased, such that a density of a black solid image tended to be decreased.

Subsequently, the developing roller was detached from the process cartridge, and the developing roller 1 obtained in Example 1 was mounted therein.

<Evaluation 8-1: Density of Black Solid Image at First Sheet Output from Standby State>

The process cartridge was placed into the electrophotographic image forming apparatus and was allowed to stand for 24 hours in an environment of a temperature of 23° C. and a relative humidity of 55%. Then, the electrophotographic image forming apparatus was turned on and an initial sequence of the process cartridge was performed. In this state, the process cartridge was additionally allowed to stand for 24 hours to be in a standby state.

Next, an image was printed at a speed of 60 sheets/min.

A letter-sized black solid image was continuously printed on two sheets from the standby state, and an image density of the obtained black solid image was measured using a spectrodensitometer (trade name: X-Rite 508, manufactured by Xrite). First, an average of densities at a front end (position at 10 mm from an end portion on the upstream side in a printing direction) and a back end (position at 10 mm from an end portion on the downstream side in the printing direction) of the image printed at the first sheet output from the standby state was obtained and determined as the density of the solid black image at the first sheet output.

Next, an average of densities at a front end (position at 10 mm from an end portion on the upstream side in the printing direction) and a back end (position at 10 mm from an end portion on the downstream side in the printing direction) of the image at the second sheet output was obtained and determined as the density of the solid black image at the second sheet output. A value obtained by subtracting the density of the black solid image at the first sheet output from the density of the black solid image at the second sheet output was determined as the density difference of the black solid image.

The image density was evaluated for the obtained image density difference of the black solid image. The evaluation criteria were as follows.

Rank A: the density difference of the black solid image was less than 0.05.

Rank B: the density difference of the black solid image was 0.05 or more and less than 0.10.

Rank C: the density difference of the black solid image was 0.10 or more and less than 0.15.

Rank D: the density difference of the black solid image was 0.15 or more and less than 0.20.

Rank E: the density difference of the black solid image was 0.20 or more.

<Evaluation 8-2: Evaluation of Black Spot>

The black solid image obtained in the evaluation of the image density was observed, and the presence or absence of black spots was evaluated according to the following criteria.

Rank A: there were no black spots in a cycle of the developing roller.

Rank B: there was a black spot in a cycle of the developing roller.

Examples 2 to 7

Six porous rollers for a developing roller according to Examples 2 to 7 were manufactured in the same manner as in the porous roller according to Example 1 except that an inner diameter of the mold was changed so that outer diameters of the porous rollers had the following sizes, respectively:

Example 2: 2.08 mm;
Example 3: 2.07 mm;
Example 4: 2.03 mm;
Example 5: 1.94 mm;
Example 6: 1.88 mm;
Example 7: 1.79 mm.

Six solid layer forming materials different in total solid content were prepared in the same manner as in the solid layer forming material B-1 except that the total solid content was adjusted so that a thickness of the solid layer became the value described in Table 2. A solid layer was formed on each of the porous layer of the six porous rollers prepared above in the same manner as in the method of forming the solid layer according to Example 1 except that the above-mentioned materials were used.

Subsequently, an electrical insulating portion was formed on the solid layer of each of the porous rollers in the same manner as in Example 1, thereby manufacturing developing rollers 2 to 7.

Examples 8 and 9

Two porous rollers for a developing roller according to Examples 8 and 9 were manufactured in the same manner as in the porous roller according to Example 1 except that an inner diameter of the mold was changed so that an outer diameter of porous rollers became 1.99 mm.

A solid layer was formed on a porous layer of the porous roller in the same manner as in Example 1 except that the solid layer forming material B-2 or B-3 was used. Subsequently, developing rollers 8 and 9 were obtained by forming an electrical insulating portion disposed on the solid layer in the same manner as in Example 1.

Examples 10 and 11

An inner diameter of the mold was changed so that an outer diameter of a porous roller became 1.98 mm, and a mixing amount of foam stabilizer in the porous layer forming material A-1 was changed to 0.3 parts by mass or 2.0 parts by mass. Porous rollers were manufactured in the same manner as in Example 1 except for the above-mentioned differences. Subsequently, a solid layer was formed on a porous layer in the same manner as in Example 1. Further, developing rollers 10 and 11 were obtained by forming an electrical insulating portion disposed on the solid layer in the same manner as in Example 1.

Examples 12 and 13

<1. Formation of Porous Roller>

An amount of nitrogen gas blown into the porous layer forming material A-1 was adjusted so that a porosity of a porous layer became 16% or 79%.

Porous rollers were manufactured in the same manner as in Example 1 except that the porous layer forming material A-1 in which the amount of blown nitrogen gas was injected into the mold of which an inner diameter was changed so that an outer diameter of the porous roller became 1.98 mm.

<2. Formation of Solid Layer>

A solid layer was formed on an outer peripheral surface of a porous layer of the porous roller in the same manner as in Example 1.

<3. Formation of Electrical Insulating Portion>

Developing rollers 12 and 13 were manufactured by forming an electrical insulating portion disposed on an outer peripheral surface of the solid layer in the same manner as in Example 1.

Example 14

A porous roller was manufactured in the same manner as in the porous roller according to Example 1 except that an inner diameter of the mold was changed so that an outer diameter of the porous roller became 1.98 mm. An electroconductive roller was obtained by forming a solid layer on a porous layer of the obtained porous roller in the same manner as in Example 1. Subsequently, a developing roller 14 was obtained by forming an electrical insulating portion in the same manner as in Example 1 except that the electrical insulating portion forming material C-2 was used.

Example 15

A porous roller was manufactured in the same manner as in the porous roller according to Example 1 except that an inner diameter of the mold was changed so that an outer diameter of the porous roller became 1.98 mm. Next, a solid layer was formed on a porous layer of the porous roller in the same manner as in Example 1 except that the solid layer forming material B-4 was used.

Subsequently, a developing roller 15 was manufactured by forming an electrical insulating portion disposed on the solid layer in the same manner as in Example 1.

Examples 16 and 17

A porous roller was manufactured in the same manner as in the porous roller according to Example 1 except that an inner diameter of the mold was changed so that an outer diameter of the porous roller became 1.98 mm. Next, solid layer was formed on a porous layer on the porous roller in the same manner as in Example 1.

Developing rollers 16 and 17 were manufactured by forming an electrical insulating portion disposed on the solid layer in the same manner as in Example 1 except that an ejection interval of an ink jet head was changed in order to change an occupancy ratio of the electrical insulating portion.

Examples 18 to 21

A porous roller was manufactured in the same manner as in the porous roller according to Example 1 except that an inner diameter of the mold was changed so that an outer diameter of the porous roller became 1.98 mm. A solid layer was formed on a porous layer of the porous roller in the same manner as in Example 1.

Subsequently, developing rollers 18 to 21 were manufactured by forming an electrical insulating portion disposed on the solid layer in the same manner as in Example 1 except that an ejection amount of the electrical insulating portion forming material C-1 from an ink jet head was changed to three steps in order to change a height of the electrical insulating portion.

Example 22

A porous roller was manufactured in the same manner as in the porous roller according to Example 1 except that an inner diameter of the mold was changed so that an outer diameter of the porous roller became 1.98 mm. Next, a first solid layer was formed on a porous layer of the porous roller in the same manner as in Example 1 except that the solid layer forming material B-5 was used. Subsequently, a second solid layer was formed on an outer peripheral surface of the first solid layer in the same manner as in Example 1 except that the solid layer forming material B-1 was used. Further, a developing roller 22 was manufactured by forming an electrical insulating portion disposed on an outer peripheral surface of the second solid layer in the same manner as in Example 1.

Example 23

A porous roller was manufactured in the same manner as in the porous roller according to Example 10.

Next, a solid layer having a thickness of 11 μm was formed on an outer peripheral surface of a porous layer of the porous roller in the same manner as in Example 1 except that the solid layer forming material B-6 was used. Convex portions derived from resin particles Be-1 and Bf-1 were formed on an outer surface of the solid layer. Further, the thickness of the solid layer was a thickness in a region in which there was no convex portion derived from the resin particles Be-1 and Bg-1 in the solid layer.

Next, an outer peripheral surface of the solid layer was abrased by 5 μm in a thickness direction using a rubber roller exclusive Grinding (trade name: SZC, manufactured by Mizuguchi Seisakusho Co., Ltd.) to make the thickness of the solid layer to be 6 μm. At the same time, a part of the resin particles Be-1 and Bf-1 in the solid layer were abrased to cause abrased surfaces of the resin particles Be-1 and Bf-1 to be exposed to the outer surface of the solid layer. As described above, a developing roller 23 having an outer surface to which the abrased surfaces of the resin particles Be-1 and Bf-1 were exposed, the abrased surfaces of the resin particles constituting the electrically insulating portion, was manufactured.

Example 24

A Porous roller was manufactured in the same manner as in Example 11.

A solid layer having a thickness of 306 μm was formed in the same manner as in Example 1 except that the solid layer forming material B-7 was used. Convex portions derived from resin particles Be-1 and Bg-1 were formed on an outer surface of the solid layer. Further, the thickness of the solid layer was a thickness in a region in which there was no convex portion derived from the resin particles Be-1 and Bf-1 in the solid layer.

Then, the outer surface of the solid layer was abrased by 5 μm in a thickness direction in the same manner as in Example 23, such that the thickness of the solid layer became 301 μm. At the same time, part of the resin particles Be-1 and Bf-1 were abrased to cause abrased surfaces of the resin particles Be-1 and Bg-1 to be exposed to the outer surface of the solid layer. As described above, a developing roller 24 having an outer surface to which the abrased surfaces of the resin particles Be-1 and Bg-1 were exposed, the abrased surfaces of the resin particles Be-1 and Bg-1 constituting the electrical insulating portions, was manufactured.

Example 25

A porous roller was manufactured in the same manner as in the porous roller according to Example 1 except that an inner diameter of the mold was changed so that an outer diameter of the porous roller became 1.98 mm.

A solid layer having a thickness of 102 μm was formed on an outer peripheral surface of a porous layer of the porous roller in the same manner as in Example 1 except that the solid layer forming material B-6 was used. Convex portions derived from resin particles Be-1 and Bf-1 were formed on an outer surface of the solid layer. Further, the thickness of the solid layer is a thickness in a region in which there was no convex portion derived from the resin particles Be-1 and Bf-1 in the solid layer.

Next, the outer surface of the solid layer was abrased by 10 μm in a thickness direction in the same manner as in Example 23, such that the thickness of the solid layer became 92 μm, and at the same time, part of the resin particles Be-1 and Bf-1 were abrased to cause abrased surfaces of the resin particles Be-1 and Bf-1 were exposed to the outer surface of the solid layer. As described above, a developing roller 25 having an outer surface to which the abrased surfaces of the resin particles Be-1 and Bf-1 were exposed, the abrased surfaces of the resin particles Be-1 and Bf-1 constituting the electrical insulating portions, was manufactured.

Example 26

A developing roller 26 was manufactured in the same manner as in Example 25 except that the solid layer forming material 7 was used, and a solid layer was formed so as to have a thickness before abrasing of 101 μm. The developing roller 26 had a solid layer with a thickness of 91 μm, and had an outer surface to which abrased surfaces of the resin particles Be-1 and Be-2 were exposed, the exposed abrased surfaces of the resin particles Be-1 and Be-2 constituting the electrical insulating portion Example 27

A first solid layer (thickness: 89 μm) and a second solid layer (thickness: 99 μm) were formed in the same manner as in Example 22 except that the solid layer forming materials B-1 and B-6 were used. Next, the second solid layer was abrased by 10 μm in a thickness direction in the same manner as in Example 23, such that the thickness of the solid layer became 89 μm, and at the same time, part of the resin particles Be-1 and Bf-1 were abrased to cause abrased surfaces of the resin particles Be-1 and Bf-1 were exposed to an outer surface of the solid layer. As described above, a developing roller 27 having an outer surface to which the abrased surfaces of the resin particles Be-1 and Bf-1 were exposed, the abrased surfaces of the resin particles Be-1 and Bf-1 constituting the electrical insulating portions, was manufactured.

Example 28

A porous roller was manufactured in the same manner as in the porous roller according to Example 1 except that an inner diameter of the mold was changed so that an outer diameter of the porous roller became 1.88 mm. A solid layer was formed on a porous layer of the porous roller in the same manner as in Example 1.

Next, a longitudinal direction of the porous roller having the solid layer prepared above was made vertical direction. A layer of the phase-separated resin layer forming material B-8 was formed on an outer peripheral surface of the solid layer by immersing the porous roller in the phase-separated resin layer forming material B-8 while holding an upper end portion thereof and then pulling the porous roller up. An immersion time was 9 seconds, and an initial pulling speed from a coating solution was 30 mm/s, a final pulling speed was 20 mm/s, and the speed was changed linearly with time therebetween.

Next, a porous roller in which a layer of the phase-separated resin layer forming material B-8 was applied on the solid layer was dried in an oven at a temperature of 80° C. for 15 minutes and then heated at a temperature of 140° C. for 2 hours, thereby curing the layer the phase-separated resin layer forming material B-8. A developing roller 28 having a phase-separated resin layer on an outer peripheral surface of the solid layer was manufactured as described above.

The phase-separated resin layer was a layer in which a urethane resin containing carbon black dispersed therein and polyethylene terephthalate were phase-separated and formed an electroconductive portion and an electrical insulating portion, respectively. Further, the electrical insulating portion came in contact with the solid layer.

Example 29

A developing roller 29 was manufactured in the same manner as in Example 28 except that the phase-separated resin layer forming material B-9 was used.

Example 30

«Manufacturing of Electroconductive Nylon Fiber for Forming First Region»

A mixture obtained by mixing 30 parts by mass of carbon black (trade name: Toka black #7360SB, manufactured by Tokai Carbon Co., Ltd.) with 100 parts by mass of pellets of 12 nylon (trade name: UBESTA, manufactured by Ube Industries, Ltd.) was charged into a twin-screw extruder, thereby obtaining a thermoplastic electroconductive nylon fiber corresponding to a strand type composition having a diameter of 80 μm.

«Manufacturing of Insulating Nylon Fiber for Forming Second Region»

Pellets of 12 nylon (trade name: UBESTA, manufactured by Ube Industries, Ltd.) was charged into a twin-screw extruder, thereby obtaining a thermoplastic insulating nylon fiber corresponding to a strand type composition having a diameter of 80 μm.

«Manufacturing of Developing Roller 30»

A porous layer was formed in the same manner as in Example 1 except that an inner diameter of the mold was adjusted so that a thickness of the porous layer became 3.00 mm. Subsequently, the porous layer was abrased to a thickness of 2.92 mm using a rubber roll mirror surface processing machine (trade name: SZC, manufactured by Mizuguchi Seisakusho Co., Ltd.), such that a porous roller in which pores (cells) of the porous layer were partially exposed to an outer surface of the porous layer was manufactured.

Then, a solid layer was formed on an outer peripheral surface of the porous layer in the same manner as in Example 1 except that the solid layer forming material B-5 was used.

Next, a bundle of two strands of the electroconductive nylon fiber prepared above and one strand of insulating nylon fiber prepared above were wound around the outer peripheral surface of the solid layer to completely cover the outer peripheral surface of the solid layer. In this case, the bundle of two strands of the electroconductive nylon fiber and one strand of insulating nylon fiber were spirally wound so as to be adjacent to each other and to form an included angle of 30 degrees with respect to a circumferential direction of the porous roller. Thereafter, the electroconductive nylon fiber and the insulating nylon fiber were heated in a cylindrical mold at a temperature of 200° C. for 3 minutes to thereby be melted. In this manner, a developing roller 30 in which a spiral electrical insulating portion and an electroconductive portion are formed in a spiral shape was manufactured.

Comparative Example 1

<1. Formation of Solid Elastic Layer Roller>

«1. Formation of Solid Elastic Layer»

A primer (trade name: DY35-051, manufactured by Dow Corning Toray Co., Ltd.) was applied and baked onto an outer peripheral surface of a cylindrical body made of stainless steel (SUS 304) and having an outer diameter of 6 mm and a length of 269.0 mm, thereby preparing a substrate of a developing roller according to Comparative Example 1.

As a solid elastic layer forming material, a mixture of 100 parts by mass of a liquid silicone rubber material (trade name: SE6724A/B, manufactured by Dow Corning Toray Co., Ltd), 20 parts by mass of carbon black (trade name: Toka Black #7360SB, manufactured by Tokai Carbon Co., Ltd.), and 0.1 part by mass of a platinum catalyst was prepared.

The substrate was disposed in a mold, and the elastic layer forming material was injected in a cavity forming in the mold, and the mold was heated to 150° C. and maintained for 15 minutes, followed by curing. After curing, an elastic layer corresponding to an electroconductive solid having a thickness of 2.80 mm was formed on an outer peripheral surface of the substrate by removing the mold and additionally heating at a temperature of 180° C. for 1 hour to complete a curing reaction.

<2. Formation of Solid Layer»

A solid layer was formed on an outer peripheral surface of the solid elastic layer in the same manner as in Example 1.

<3. Formation of Electrical Insulating Portion>

A developing roller 31 was manufactured by forming an electrical insulating portion disposed on an outer peripheral surface of the solid layer in the same manner as in Example 1.

Comparative Example 2

A developing roller 32 was manufactured in the same manner as in Example 1 except that a solid layer was not formed. That is, in the developing roller 32, an electrical insulating portion was formed on an outer peripheral surface of a porous layer.

Comparative Example 3

<1. Formation of Porous Layer Roller>

A porous layer was formed on a substrate in the same manner as in Example 1. Next, a surface of the porous layer was abrased using a rubber roll mirror surface processing machine (trade name: SZC, manufactured by Mizuguchi Seisakusho Co., Ltd.) to expose pores of the porous layer on an outer peripheral surface of the porous layer, thereby manufacturing a porous layer roller having an unevenness on the outer peripheral surface of the porous layer.

<2. Formation of Electrical Insulating Portion>

A coating solution having a solid content of 40% was prepared by adding MEK to the electrical insulating portion forming material C-1. An electrical insulating portion was formed on an outer peripheral surface of the porous layer roller by holding an upper end portion of the substrate and immersing the porous roller in the coating solution in a state in which a longitudinal direction of the porous layer roller became a vertical direction and then pulling the porous roller up.

An immersion time was 9 seconds, and an initial pulling speed from a coating solution was 30 mm/s, a final pulling speed was 20 mm/s, and the speed was changed linearly with time therebetween. The obtained coating product was dried in an oven at a temperature of 80° C. for 30 minutes, and then irradiated with ultraviolet light for 10 minutes using a low-pressure mercury lamp so as to have a wavelength of 254 nm and an integrated light quantity of 1500 mJ/cm$^2$, thereby curing the applied coating solution.

Thereafter, a developing roller 33 was obtained by exposing a part of the porous layer and an electrical insulating portion filled in the pores of the porous layer using a rubber roll mirror surface processing machine (trade name: SZC, manufactured by Mizuguchi Seisakusho Co., Ltd.).

Comparative Example 4

A developing roller 34 was manufactured in the same manner as in Example 30 except that a solid layer was not formed.

As a result of observing a contact state between the electrical insulating portion and the porous layer in a cross section in a direction parallel to a circumferential direction of developing roller 34, it was possible to confirm the presence of the electrical insulating portion coming in contact with both a skeleton portion of the porous layer and pores exposed on the surface of the porous layer.

The solid layer forming materials and the electrical insulating portion forming materials used to manufacture the developing roller 1 to 34 according to Examples 1 to 30 and Comparative Examples 1 to 4 and an outline of the method of manufacturing the electrical insulating portion were summarized in Table 3.

Further, the developing rollers 2 to 34 according to Examples 2 to 30 and Comparative Examples 1 to 4 were subjected to Evaluations 1 to 8 in the same manner as in the developing roller 1 according to Example 1. Evaluation results of the developing rollers 1 to 34 according to Examples 1 to 30 and Comparative Examples 1 to 4 are shown in Tables 4 and 5.

TABLE 3

| | | | First Solid Layer | | Second Solid Layer | | Electrical Insulating Portion | |
|---|---|---|---|---|---|---|---|---|
| | | Developing Roller No. | Forming Material No. | Solid Content (%) | Raw Material No. | Solid Content (%) | Raw Material No. | Formation Method |
| Example | 1 | 1 | B-1 | 40 | — | — | C-1 | Ink Jet |
| | 2 | 2 | | 20 | — | — | | |
| | 3 | 3 | | 25 | — | — | | |
| | 4 | 4 | | 30 | — | — | | |
| | 5 | 5 | | 50 | — | — | | |
| | 6 | 6 | | 55 | — | — | | |
| | 7 | 7 | | 60 | — | — | | |
| | 8 | 8 | B-2 | 40 | — | — | | |
| | 9 | 9 | B-3 | 40 | — | — | | |
| | 10 | 10 | B-1 | 40 | — | — | | |
| | 11 | 11 | | 40 | — | — | | |

TABLE 3-continued

| | | | First Solid Layer | | Second Solid Layer | | Electrical Insulating Portion | |
|---|---|---|---|---|---|---|---|---|
| | | Developing Roller No. | Forming Material No. | Solid Content (%) | Raw Material No. | Solid Content (%) | Raw Material No. | Formation Method |
| | 12 | 12 | | 40 | — | — | | |
| | 13 | 13 | | 40 | — | — | | |
| | 14 | 14 | | 40 | — | — | C-2 | |
| | 15 | 15 | B-4 | 40 | — | — | C-1 | |
| | 16 | 16 | B-1 | 40 | — | — | | |
| | 17 | 17 | | 40 | — | — | | |
| | 18 | 18 | | 40 | — | — | | |
| | 19 | 19 | | 40 | — | — | | |
| | 20 | 20 | | 40 | — | — | | |
| | 21 | 21 | | 40 | — | — | | |
| | 22 | 22 | B-5 | 40 | B-1 | 40 | | |
| | 23 | 23 | B-6 | 25 | — | — | — | Exposure by |
| | 24 | 24 | B-7 | 65 | — | — | — | Abrasing |
| | 25 | 25 | B-6 | 40 | — | — | — | |
| | 26 | 26 | B-7 | 40 | — | — | — | |
| | 27 | 27 | B-1 | 40 | B-6 | 40 | — | |
| | 28 | 28 | B-1 | 40 | B-8 | 40 | — | Phase-separation |
| | 29 | 29 | B-1 | 40 | B-9 | 40 | — | Phase-separation |
| | 30 | 30 | B-5 | 40 | Electroconductive Nylon | | Insulating Nylon | Fiber Winding |
| Comparative | 1 | 31 | B-1 | 40 | — | — | C-1 | Ink Jet |
| Example | 2 | 32 | — | — | — | — | | |
| | 3 | 33 | — | — | — | — | | Dipping /Abrasing |
| | 4 | 34 | — | — | Electroconductive Nylon | | Insulating Nylon | Fiber winding |

TABLE 4

| | Porous Layer | | | Solid Layer 1 | | | Electroconductive Portion | | |
|---|---|---|---|---|---|---|---|---|---|
| Developing Roller No. | Cell Diameter (μm) | Porosity (%) | Volume Resistivity (Ω · cm) | Thickness (μm) | Elastic Modulus (MPa) | Volume Resistivity (Ω · cm) | Thickness (μm) | Elastic Modulus (Mpa) | Volume Resistivity (Ω · cm) |
| 1 | 95 | 33 | $6.8 \times 10^5$ | 95 | 30 | $3.0 \times 10^5$ | — | — | — |
| 2 | 101 | 34 | $6.8 \times 10^5$ | 5 | 30 | $3.1 \times 10^5$ | — | — | — |
| 3 | 95 | 30 | $7.2 \times 10^5$ | 11 | 30 | $3.3 \times 10^5$ | — | — | — |
| 4 | 101 | 30 | $6.5 \times 10^5$ | 53 | 30 | $4.1 \times 10^5$ | — | — | — |
| 5 | 102 | 32 | $6.6 \times 10^5$ | 154 | 30 | $5.2 \times 10^5$ | — | — | — |
| 6 | 105 | 29 | $6.7 \times 10^5$ | 204 | 30 | $3.7 \times 10^5$ | — | — | — |
| 7 | 94 | 26 | $6.9 \times 10^5$ | 297 | 30 | $3.8 \times 10^5$ | — | — | — |
| 8 | 93 | 27 | $8.1 \times 10^5$ | 98 | 10 | $3.9 \times 10^5$ | — | — | — |
| 9 | 100 | 32 | $7.0 \times 10^5$ | 95 | 100 | $6.1 \times 10^5$ | — | — | — |
| 10 | 10 | 31 | $7.3 \times 10^5$ | 103 | 30 | $5.8 \times 10^5$ | — | — | — |
| 11 | 299 | 30 | $6.8 \times 10^5$ | 99 | 30 | $3.5 \times 10^5$ | — | — | — |
| 12 | 108 | 16 | $8.0 \times 10^5$ | 105 | 30 | $3.5 \times 10^5$ | — | — | — |
| 13 | 105 | 79 | $7.5 \times 10^5$ | 106 | 30 | $4.3 \times 10^5$ | — | — | — |
| 14 | 107 | 30 | $7.7 \times 10^5$ | 99 | 30 | $4.9 \times 10^5$ | — | — | — |
| 15 | 105 | 30 | $8.2 \times 10^5$ | 102 | 30 | $9.8 \times 10^{11}$ | — | — | — |
| 16 | 102 | 32 | $9.0 \times 10^5$ | 101 | 30 | $4.5 \times 10^5$ | — | — | — |
| 17 | 94 | 30 | $6.6 \times 10^5$ | 99 | 30 | $3.2 \times 10^5$ | — | — | — |
| 18 | 99 | 35 | $6.8 \times 10^5$ | 99 | 30 | $4.4 \times 10^5$ | — | — | — |
| 19 | 96 | 30 | $6.9 \times 10^5$ | 102 | 30 | $4.5 \times 10^5$ | — | — | — |
| 20 | 97 | 28 | $8.8 \times 10^5$ | 105 | 30 | $3.7 \times 10^5$ | — | — | — |
| 21 | 101 | 30 | $8.0 \times 10^5$ | 101 | 30 | $5.3 \times 10^5$ | — | — | — |
| 22 | 100 | 25 | $6.3 \times 10^5$ | 100 | 30 | $5.5 \times 10^5$ | 100 | 30 | $3.0 \times 10^5$ |
| 23 | 11 | 16 | | 6 | 10 | $3.7 \times 10^5$ | — | — | — |
| 24 | 295 | 79 | | 301 | 100 | $3.1 \times 10^5$ | — | — | — |
| 25 | 102 | 32 | | 92 | 30 | $5.7 \times 10^5$ | — | — | — |
| 26 | 100 | 29 | | 91 | 30 | $3.8 \times 10^5$ | — | — | — |
| 27 | 97 | 32 | | 89 | 30 | $3.4 \times 10^5$ | 90 | 30 | $5.2 \times 10^5$ |
| 28 | 99 | 30 | $6.2 \times 10^5$ | 102 | 30 | $4.0 \times 10^5$ | 100 | 30 | $5.0 \times 10^5$ |
| 29 | 100 | 33 | $9.1 \times 10^5$ | 103 | 30 | $4.2 \times 10^5$ | 100 | 30 | $3.8 \times 10^{11}$ |
| 30 | 95 | 33 | 6.8 × 105 | 100 | 30 | $6.1 \times 10^5$ | — | — | — |
| 31 | Solid Elastic Layer | | | 100 | 30 | $4.0 \times 10^5$ | — | — | — |
| 32 | 10 | 15 | $8.1 \times 10^5$ | — | — | — | — | — | — |
| 33 | 100 | 30 | $8.2 \times 10^5$ | — | — | — | — | — | — |
| 34 | 100 | 30 | $6.9 \times 10^5$ | — | — | — | 80 | 30 | $4.6 \times 10^5$ |

TABLE 4-continued

| Developing Roller No. | Electrical Insulating Portion Height (μm) | Volume Resistivity (Ω · cm) | Occupancy Ratio (%) | Potential Decay Time Constant(sec) First Region | Second Region |
|---|---|---|---|---|---|
| 1 | 1.0 | $5.1 \times 10^{15}$ | 28 | 29580.0 | Less than Measurement Limit |
| 2 | 0.9 | $5.6 \times 10^{15}$ | 30 | 30000.0 | Less than Measurement Limit |
| 3 | 1.0 | $6.8 \times 10^{15}$ | 27 | 43015.0 | Less than Measurement Limit |
| 4 | 1.1 | $6.3 \times 10^{15}$ | 30 | 37822.0 | Less than Measurement Limit |
| 5 | 1.0 | $6.7 \times 10^{15}$ | 29 | 40531.0 | Less than Measurement Limit |
| 6 | 1.2 | $4.8 \times 10^{15}$ | 30 | 26810.0 | Less than Measurement Limit |
| 7 | 1.0 | $4.8 \times 10^{15}$ | 31 | 26900.0 | Less than Measurement Limit |
| 8 | 0.8 | $4.9 \times 10^{15}$ | 30 | 31000.0 | Less than Measurement Limit |
| 9 | 0.9 | $5.6 \times 10^{15}$ | 32 | 29111.0 | Less than Measurement Limit |
| 10 | 0.9 | $5.7 \times 10^{15}$ | 30 | 33221.0 | Less than Measurement Limit |
| 11 | 1.0 | $4.5 \times 10^{15}$ | 33 | 26300.0 | Less than Measurement Limit |
| 12 | 1.0 | $4.9 \times 10^{15}$ | 30 | 27320.0 | Less than Measurement Limit |
| 13 | 1.0 | $5.1 \times 10^{15}$ | 28 | 29010.0 | Less than Measurement Limit |
| 14 | 1.1 | $1.1 \times 10^{13}$ | 30 | 60.0 | Less than Measurement Limit |
| 15 | 1.0 | $5.5 \times 10^{15}$ | 31 | 35220.0 | 6.0 |
| 16 | 1.1 | $4.4 \times 10^{15}$ | 12 | 24780.0 | Less than Measurement Limit |
| 17 | 1.0 | $4.0 \times 10^{15}$ | 58 | 25500.0 | Less than Measurement Limit |
| 18 | 0.1 | $4.5 \times 10^{15}$ | 30 | 24580.0 | Less than Measurement Limit |
| 19 | 0.5 | $5.7 \times 10^{15}$ | 30 | 33320.0 | Less than Measurement Limit |
| 20 | 5.0 | $5.6 \times 10^{15}$ | 28 | 28520.0 | Less than Measurement Limit |
| 21 | 10.0 | $3.7 \times 10^{15}$ | 30 | 19805.0 | Less than Measurement Limit |
| 22 | 1.0 | $3.8 \times 10^{15}$ | 33 | 25300.0 | Less than Measurement Limit |
| 23 | 0.0 | $5.3 \times 10^{15}$ | 30 | 27980.0 | Less than Measurement Limit |
| 24 | 0.1 | $6.1 \times 10^{15}$ | 31 | 35880.0 | Less than Measurement Limit |
| 25 | 0.0 | $4.6 \times 10^{15}$ | 30 | 27400.0 | Less than Measurement Limit |
| 26 | 0.0 | $5.1 \times 10^{18}$ | 33 | 26070000.0 | Less than Measurement Limit |
| 27 | 0.0 | $5.0 \times 10^{15}$ | 34 | 28970.0 | Less than Measurement Limit |
| 28 | 0.0 | $5.3 \times 10^{15}$ | 28 | 33122.0 | Less than Measurement Limit |
| 29 | 0.0 | $6.7 \times 10^{15}$ | 29 | 37570.0 | Less than Measurement Limit |
| 30 | 0.0 | $3.2 \times 10^{14}$ | 30 | 1872.0 | Less than Measurement Limit |
| 31 | 1.0 | $4.6 \times 10^{15}$ | 30 | 28110.0 | Less than Measurement Limit |
| 32 | 1.0 | $3.7 \times 10^{15}$ | 30 | 20100.0 | Less than Measurement Limit |
| 33 | 0.0 | $4.6 \times 10^{16}$ | 30 | 256130.0 | Less than Measurement Limit |
| 34 | 0.0 | $4.6 \times 10^{14}$ | 30 | 2241.0 | Less than Measurement Limit |

TABLE 5

| | Evaluation 8-1 | Evaluation 8-2 |
|---|---|---|
| Example 1 | A | A |
| Example 2 | C | A |
| Example 3 | B | A |
| Example 4 | A | A |
| Example 5 | A | A |
| Example 6 | B | A |
| Example 7 | B | A |
| Example 8 | A | A |
| Example 9 | A | A |
| Example 10 | A | A |
| Example 11 | A | A |
| Example 12 | A | A |
| Example 13 | A | A |
| Example 14 | D | A |
| Example 15 | D | A |
| Example 16 | B | A |
| Example 17 | B | A |
| Example 18 | B | A |
| Example 19 | A | A |
| Example 20 | B | A |
| Example 21 | A | A |
| Example 22 | A | A |
| Example 23 | A | A |
| Example 24 | A | A |
| Example 25 | B | A |
| Example 26 | B | A |
| Example 27 | B | A |
| Example 28 | B | A |
| Example 29 | C | A |
| Example 30 | B | A |
| Comparative Example 1 | E | A |
| Comparative Example 2 | E | A |

TABLE 5-continued

| | Evaluation 8-1 | Evaluation 8-2 |
|---|---|---|
| Comparative Example 3 | E | B |
| Comparative Example 4 | E | B |

From the results of the black solid image density difference in Examples 1 to 30 and Comparative Examples 1 to 4, it can be appreciated that in the developing member according to the present disclosure, the electrical insulating portion was rapidly charged. Therefore, it can be appreciated that a lack of density of the black solid image at the first sheet output from the standby state and a density change between a halftone image at the first sheet output from the standby state and a halftone image at the time of outputting several sheets were suppressed. Further, from the evaluation result of the black spot image, it can be appreciated that a high-quality electrophotographic image in which there was not black spot could be formed.

Further, from the results of the black solid image density difference in Examples 18 to 21 and Examples 25 to 27, it can be appreciated that the electrical insulating portion was more rapidly charged by forming a convex portion in the electrical insulating first region. Therefore, it can be appreciated that a lack of density of the black solid image at the first sheet output from the standby state and a density change between a halftone image at the first sheet output from the standby state and a halftone image at the time of outputting several sheets were further suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-177854, filed Sep. 21, 2018, which is hereby incorporated by reference herein in its entirety.

What is claimed is:

1. An electrophotographic developing member comprising:

a substrate;

a porous electroconductive elastic layer on the substrate; and an electroconductive solid layer on the electroconductive elastic layer, an outer surface of the developing member including a first region having an electrical insulating surface and a second region having an electroconductive surface, the first region and the second region being arranged adjacent to each other, and the first region being constituted by an electrical insulating portion disposed on an outer surface of the electroconductive solid layer, wherein a potential decay time constant, which is defined as a time taken for a surface potential to decay to V0×(1/e) when a potential of the first region constituting the outer surface of the developing member is charged to V0 (V), is 60.0 seconds or more, and a potential decay time constant, which is defined as a time taken for a surface potential to decay to V0×(1/e) when a potential of the second region constituting the outer surface of the developing member is charged to V0 (V), is less than 6.0 seconds.

2. The electrophotographic developing member according to claim 1, wherein volume resistivity of the electrical insulating portion is $1.0\times10^{13}$ to $1.0\times10^{18}$ Ω·cm.

3. The electrophotographic developing member according to claim 1, wherein the second region is constituted by the outer surface of the electroconductive solid layer.

4. The electrophotographic developing member according to claim 3, wherein volume resistivity of the electroconductive solid layer is $1.0\times10^{5}$ to $1.0\times10^{11}$ Ω·cm.

5. The electrophotographic developing member according to claim 1, wherein the second region is constituted by an outer surface of an electroconductive portion on the electroconductive solid layer.

6. The electrophotographic developing member according to claim 5, wherein volume resistivity of the electroconductive portion is $1.0\times10^{5}$ to $1.0\times10^{11}$ Ω·cm.

7. The electrophotographic developing member according to claim 1, wherein a convex portion is formed on the outer surface of the developing member by the first region.

8. The electrophotographic developing member according to claim 1, wherein a thickness of the electroconductive solid layer or a sum of thicknesses of the electroconductive solid layer and the electroconductive portion is 5 to 300 μm.

9. An electrophotographic process cartridge detachably attachable to a main body of an electrophotographic image forming apparatus, the electrophotographic process cartridge comprising:

a toner container including a toner; and a developing unit configured to convey the toner, the developing unit including an electrophotographic developing member and a developer amount regulating member disposed in contact with an outer surface of the developing member, the developing member including a substrate, a porous electroconductive elastic layer on the substrate, and an electroconductive solid layer on the electroconductive elastic layer, an outer surface of the developing member including a first region having an electrical insulating surface and a second region having an electroconductive surface, the first region and the second region being arranged adjacent to each other, and the first region being constituted by an electrical insulating portion disposed on an outer surface of the electroconductive solid layer, wherein a potential decay time constant, which is defined as a time taken for a surface potential to decay to V0×(1/e) when a potential of the first region constituting the outer surface of the developing member is charged to V0 (V), is 60.0 seconds or more, and a potential decay time constant, which is defined as a time taken for a surface potential to decay to V0×(1/e) when a potential of the second region constituting the outer surface of the developing member is charged to V0 (V), is less than 6.0 seconds.

10. An electrophotographic image forming apparatus comprising:

an electrophotographic photosensitive member;

a charging unit disposed to be able to charge the electrophotographic photosensitive member; and a developing unit configured to supply a toner to the electrophotographic photosensitive member, the developing unit including an electrophotographic developing member and a developer amount regulating member disposed in contact with an outer surface of the developing member, the developing member including a substrate, a porous electroconductive elastic layer on the substrate, and an electroconductive solid layer on the electroconductive elastic layer, an outer surface of the developing member including a first region having an electrical insulating surface and a second region having an electroconductive surface, the first region and the second region being arranged adjacent to each other, and the first region being constituted by an electrical insulating portion disposed on an outer surface of the electroconductive solid layer, wherein a potential decay time constant, which is defined as a time taken for a surface potential to decay to V0×(1/e) when a potential of the first region constituting the outer surface of the developing member is charged to V0 (V), is 60.0 seconds or more, and a potential decay time constant, which is defined as a time taken for a surface potential to decay to V0×(1/e) when a potential of the second region constituting the outer surface of the developing member is charged to V0 (V), is less than 6.0 seconds.

* * * * *